US005979574A

United States Patent [19]

Osadchuk

[11] Patent Number: 5,979,574

[45] Date of Patent: Nov. 9, 1999

[54] HORIZONTAL BORING APPARATUS AND METHOD OF USING THE SAME

[75] Inventor: Mark Osadchuk, Scottsdale, Ariz.

[73] Assignee: Ozzie's Pipeline Padder, Inc., Scottsdale, Ariz.

[21] Appl. No.: 09/018,828

[22] Filed: Feb. 4, 1998

Related U.S. Application Data

[63] Continuation-in-part of application No. 08/855,328, May 13, 1997.

[51] Int. Cl.[6] ..... E21B 10/10

[52] U.S. Cl. ..... 175/353; 175/367

[58] Field of Search ..... 175/53, 61, 62, 175/76, 82, 334, 335, 385, 391, 408, 413, 431, 432, 353, 356, 367, 366, 369, 368; 76/108.2, 108.4; 299/102, 103, 108

[56] References Cited

U.S. PATENT DOCUMENTS

| | | | |
|---|---|---|---|
| 3,833,077 | 9/1974 | Lavallee | 175/325 |
| 3,894,402 | 7/1975 | Cherrington . | |
| 3,902,563 | 9/1975 | Dunn . | |
| 3,905,431 | 9/1975 | Hasewend . | |
| 3,917,011 | 11/1975 | Hester | 175/339 |
| 4,043,136 | 8/1977 | Cherrington . | |
| 4,117,895 | 10/1978 | Ward et al. . | |
| 4,248,314 | 2/1981 | Cunningham et al. | 175/344 |
| 4,319,648 | 3/1982 | Cherrington . | |
| 5,314,267 | 5/1994 | Osadchuk . | |

FOREIGN PATENT DOCUMENTS

| | | |
|---|---|---|
| 832325 | 1/1970 | Canada . |
| 962996 | 2/1975 | Canada . |
| 1067-190 | 1/1984 | U.S.S.R. . |
| 88/08480 | 11/1988 | WIPO . |

OTHER PUBLICATIONS

"Trenchless Technology Special Product Focus", Utility Construction & Maintenance, Jun./Jul., 1992. p. 29.

*Primary Examiner*—David Bagnell
*Assistant Examiner*—Sunil Singh
*Attorney, Agent, or Firm*—Crutsinger & Booth

[57] ABSTRACT

A boring head is provided for use in mounting to a drill pipe of a drilling rig for enlarging a pilot bore in horizontal boring operations. The boring head has an axial member positioned along a central axis of the boring head for connecting the boring head to the drill pipe of the drilling rig. A plurality of internally tapered longitudinal pockets around the periphery of the axial member each receive an externally tapered body mounting an independently rotatable cutter bit which rotates about a rolling axis inclined at an angle in the range between ten and eighty degrees with respect to the central axis of the boring head. The tapered body is drawn into the tapered pocket by a threaded retainer and forced into the pocket when boring by the force of the boring head against the bore face.

15 Claims, 12 Drawing Sheets

HORIZONTAL BORING APPARATUS AND METHOD OF USING THE SAME

This application is a continuation-in-part of U.S. application Ser. No. 08/855,328, filed May 13, 1997 entitled "Horizontal Boring Apparatus and Method".

TECHNICAL FIELD

The present invention relates to horizontal boring for installation of cross-country pipelines, conduits, cables, and the like, beneath a surface obstruction or barrier such as a roadway or river.

BACKGROUND OF THE INVENTION

Pipeline must be installed under surface barriers such as highways, waterways, buildings and other surface obstructions without disturbing the surface. Typically this has been done through a process of horizontally boring beneath the surface barrier. The basic process includes opening a trench on both sides of the barrier. A boring apparatus is placed on one side of the barrier and a passageway or bore is formed under the barrier between the two open trenches. The bore is of sufficient size to allow a section of pipeline to be pushed lengthwise through the bore from one side of the highway to the other. The installed pipeline section is then welded into the pipeline and tested.

When rock or other hard materials are encountered in the boring operation, problems can arise which cause the installation to be difficult and expensive. For example, when installing a 36-inch, 40-inch, or even larger pipeline under a 300-foot wide interstate highway barrier, massive forces can be present during the process of drilling the bore for the pipeline section. When hard rock materials is encountered in the drilling process using conventional large-diameter boring apparatus and methods, it is difficult, if not impossible to form the bore along a desired path. For example, when hard rock is encountered in the drilling process, the boring head tends to corkscrew, bend, and deviate from a straight path. This causes installation of straight pipe to be difficult, if not impossible, especially the longer the underground bore. If the bore is not sufficiently straight, the pipeline section can become stuck. The stuck pipe must be cut, the bore filled up, and a new attempt made at drilling a bore and installing the pipeline section. These and other difficulties in installing large-diameter pipeline beneath a barrier cause the process to be difficult and expensive.

U.S. Pat. No. 5,314,267 issued on May 24, 1994 to Mark Osadchuk, which is incorporated herein by reference in its entirety, discloses a horizontal pipeline boring apparatus and method for installing a pipeline section under a surface barrier, such as a roadway or the like. According to that invention, a pilot bore is formed under the barrier. Next, a boring head, which is sometimes referred to in the art as a reamer or a hole opener, is used to enlarge the pilot bore. In addition, a guide is positioned on the advancing side of the boring head. The guide on the boring head is designed to engage the walls of the pilot bore and help steer the pipeline boring head during cutting along the path of the pilot bore. The pipeline section is advanced behind the boring head. Drilling liquids can be supplied to the boring operation through the pilot bore, and an auger in the pipeline section is used to help move drilling mud and cuttings away from the boring head through the pipeline section. While the apparatus and method disclosed in U.S. Pat. No. 5,314,267 controls the boring operation, improvements are desired for further control of the boring operation.

The need for improvements is particularly long-felt for large-diameter pipeline sections. The larger the diameter of the desired bore, the greater the twisting force that are created in the drilling operation. According to the laws of physics, torque is the product of the force and the perpendicular distance from the line of action of the force to the axis of rotation. The hardness of the rock, the advancing force on the boring head, and all else being equal, for any given radial distance from the axis of the boring operation, the resulting torque is a product of that radial distance. Thus, the larger the boring head, the greater the perpendicular distance from the line of action of the force to the axis of rotation. The torque is created at every point along the radial cutting swath of the boring operation, such that the integral summation of these torques increases the wider the cutting swath of the boring operation.

For example, in opening up an 9 inch pilot bore to 30 inches in a single drilling operation, the cutting swath is about radial 21 inches wide. Thus, a 30 inch diameter boring head working against hard rock in this 21 inch wide cutting swath toward the periphery of the boring head creates a substantial twisting force (torque) about the axis of the pilot bore. If attempting to open up a 9 inch pilot bore to 60 inches in a single drilling operation, the cutting swath would be about 51 inches wide, and the tremendously increased torques involved would usually make such a drilling operation impossible. Thus, it is usually not possible to enlarge the initial pilot bore to a very large diameter bore in a single drilling operation.

To install a 60-inch pipeline, for example, the relatively small pilot bore must usually be opened up to at least one intermediate diameter. If very hard rock is encountered, it may be necessary to use several stepwise drilling operations to open up the pilot bore to successively larger and larger diameter bores until the desired diameter is achieved. For example, the pilot bore may be first enlarged to 24 inches, then in a second drilling operation be enlarged to about 42 inches, and finally in a third drilling operation enlarged to 60 inches.

Despite enlarging the pilot bore in stepwise drilling operations, in opening up a 42 inch bore to 60 inches, for example, the 60 inch diameter boring head working against hard rock in the 18-inch cutting swath toward the periphery of the boring head creates tremendous twisting force about the axis of the pilot bore. Even if the guide in the pilot bore helps maintains the drilling operation in a substantially straight line, the tremendous twisting force causes the drilling operation to drill eccentrically of the central axis of the pilot bore. With each successive drilling operation to increase the bore size, the off-center drilling creates an increasingly misshapen bore, which tends to become increasingly triangular and can be loosely described as an "A" shaped. This then requires that a substantially larger bore must be formed to install the desired large pipeline, which costs time and money.

Furthermore, the twisting forces created in the drilling operation can be so large that the boring head becomes increasingly likely to completely twist off its drive shaft, also referred to as a drill pipe. If the boring head twists off the drill pipe, retrieving the boring head can be very time consuming and expensive, and the boring operation may have to be abandoned in favor of a new attempt.

Thus, there has been a long-felt need for an improved boring head and method that is more easily controlled to form a straight bore, that produces a more perfectly circular bore, and is much less likely to cause the boring head to twist off the drill pipe.

SUMMARY OF THE INVENTION

According to the invention, a boring head is provided for use in mounting to a drill pipe of a drilling rig for enlarging a pilot bore in horizontal boring operations. The boring head has an axial member positioned along a central axis of the boring head for connecting the boring head to the drill pipe of the drilling rig. A plurality of flanges extend radially from the axial member, and a flange support frame is provided for structurally interconnecting and supporting the flanges on the axial member. A plurality of cutting cones are mounted to the boring head. In particular, each of the cutting cones has a cone axis, each of the cutting cones is mounted to one of the flanges such that its cone axis extends at an acute angle ranging from zero degrees up to about 45 degrees relative to the central axis; each of the cutting cones is mounted for independent rotation about its cone axis; and each of the cutting cones has a plurality of independently rotatable cutter bits mounted thereto.

According to a further aspect of the invention, the improved boring head has the cone axis of at least a first one of the plurality of cutting cones mounted a first radial distance from the central axis, and the cone axis of at least a second one of the plurality of cutting cones is mounted a second radial distance from the central axis. As the boring head is rotated, the first and second cutting cones rotate about different radii relative to the central axis, thereby sharing and distributing the cutting load between the cutting cones. According to another aspect of the invention, the first cutting cone is mounted such that its cone axis extends substantially parallel to the central axis, and the second cutting cone is mounted such that its cone axis extends at an acute angle up to 45 degrees relative to the central axis, but more preferably at an angle of about 30 degrees relative to the central axis. According to a still further aspect of the invention, the difference between the first radial distance and the second radial distance from the central axis is less than the sum of the first and second radial cutting dimensions about the respective cone axes of the first and second cutting cones, whereby the first and second cutting cones cut across different but overlapping widths of arcuate cutting paths relative to the central axis.

A method of horizontally drilling for installing a pipeline beneath a barrier is also provided. The method includes the steps of:

(a) positioning a horizontal drilling rig having a rotator and a drill pipe at one side of the barrier;

(b) drilling a pilot bore beneath the barrier;

(c) connecting a boring head to the drill pipe of the drilling rig, the boring head further comprising:

(i) an axial member for connecting the boring head to the drill pipe of the drilling rig;

(ii) a plurality of flanges extending radially from the axial member;

(iii) a cylindrical body defining a central axis, the plurality of flanges structurally supporting the cylindrical body on the axial member and such that the axial member is positioned along the central axis of the cylindrical body;

(iv) a plurality of cutting cones, wherein each of the cutting cones has a cone axis, each of the cutting cones is mounted to one of the flanges such that its cone axis extends at an acute angle up to 45 degrees relative to the central axis of the cylindrical body; each of the cutting cones is mounted for independent rotation about its cone axis; and each of the cutting cones has a plurality of independently rotatable cutter bits mounted thereto;

(d) connecting a fluid supply tubing to the boring head, the tubing having fluid ports for providing drilling fluid to the region of the boring head;

(e) connecting a drilling fluid pump to the fluid supply tubing;

(f) connecting a cylindrical guide to the tubing for guiding the boring head through the pilot bore; and (g) advancing the drilling rig while rotating the boring head and supplying drilling fluid to the boring head, thereby enlarging the pilot bore.

According to another aspect of the present inventions, a horizontal boring head is equipped for facilitated replacement of rotating cutter bits. Here, rotating cutter bit assembly bodies are provided with a longitudinally oriented taper which is tightly received by an internally tapered pocket on the boring head. In a preferred embodiment, the parts are drawn together and retained by a threaded fastener and further augmented by working loads.

According to yet another aspect of the present inventions a horizontal boring head is provided with improved guidance and stability for following and enlarging a pilot bore. Here, the boring head of the present inventions is further equipped with both leading and trailing cylindrical guides for enlarging bore holes or secondary holes to a larger diameter. In these inventions, a leading cylindrical guide is sized to engage the primary bore diameter and concentrically attached to the boring head axial central member so as to penetrate in advance of the boring head. A trailing cylindrical guide is sized to engage the larger secondary diameter and concentrically attached to the boring head axial center member where it follows behind in the enlarged bore. Thus, the boring head is supported on both ends, across the bore face, so as to be guided and stabilized to better follow the path of the primary secondary bore. This added stability is particularly beneficial for lengthy pilot bore enlargements and more especially so as the ratio of the enlarged bore diameter to the pilot bore diameter increases.

These and other features and advantages of the present invention will be more readily appreciated from the following detailed description of a preferred embodiment.

BRIEF DESCRIPTION OF THE DRAWINGS

The accompanying drawings are incorporated into and form a part of the specification to illustrate several examples according to the presently most preferred embodiments of the present invention. The drawings are only for illustrating preferred and alternative examples of the inventive methods and structures and are not to be construed as limiting the invention to only the illustrated and described examples. The drawings include the following figures.

DETAILED DESCRIPTION OF PREFERRED EMBODIMENTS

Figure 1:
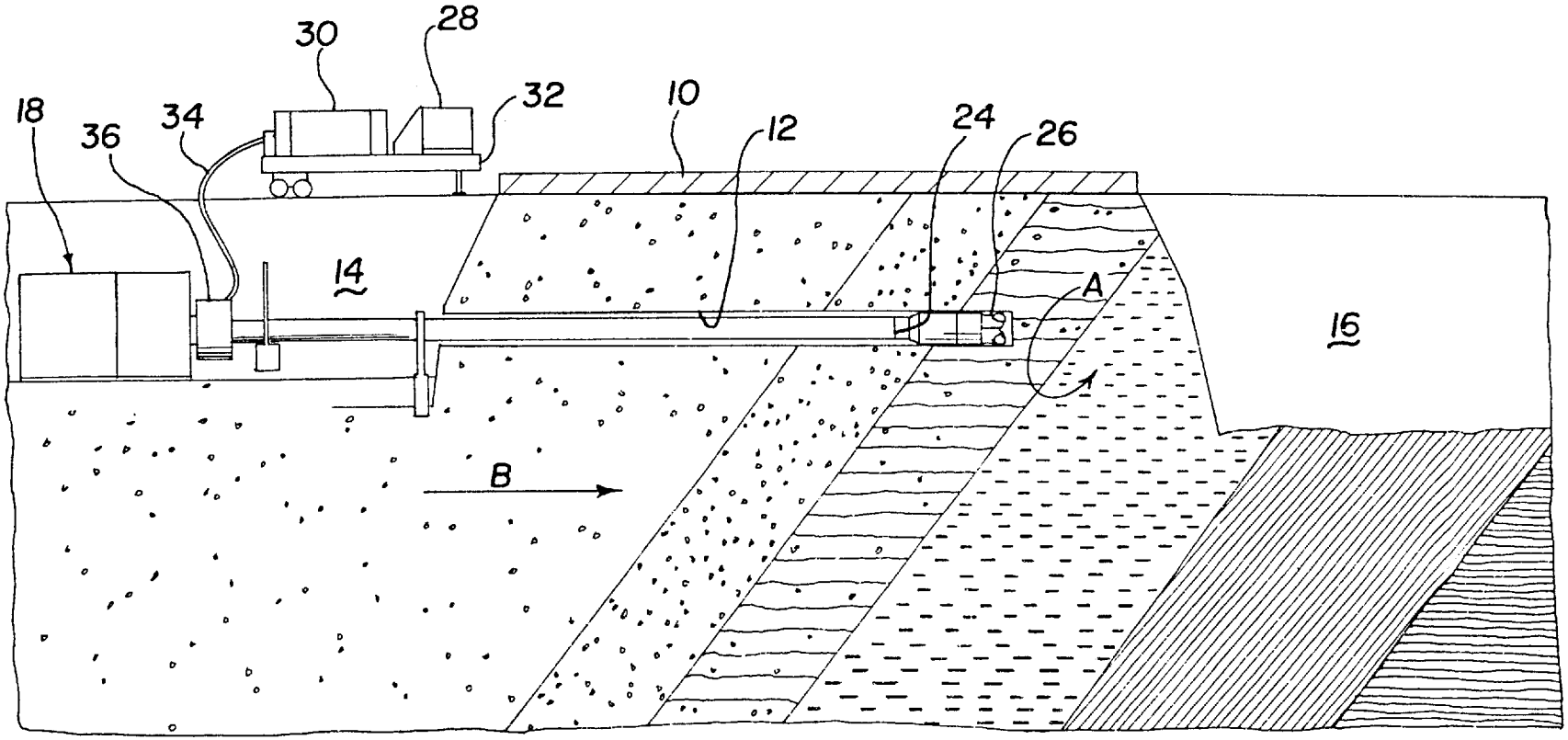
FIG. 1 is a schematic view illustrating a first step of drilling a pilot bore according to the method of making a larger diameter bore for a pipe section under a barrier.

Referring now to the drawings wherein like reference characters designate like or corresponding parts throughout the Figures, the method of the present invention will be generally described by reference to FIGS. 1 through 4. These figures generally illustrate the process of drilling a pipeline bore and installing a pipeline section under an existing roadway according to one embodiment of the present invention. It is to be understood that while the methods of the present invention are illustrated with straight horizontal boring, curves in the pipeline are possible and the horizontal boring can include boring along a desired curve. For example, in the case of boring beneath a river, it may be necessary to bore to get below the barrier along downwardly curved path.

A surface barrier, such as a roadway barrier 10 is illustrated in FIGS. 1 through 4 for purposes of explaining the present invention. In the present illustration, roadway barrier 10 is representative of any type of barrier across which a trench cannot practically be formed. The present invention has applications with other kinds of barriers that prevent the formation of a trench thereacross. Other examples are waterways, canals, buildings and the like, and the barrier can be several thousand feet across. It is to be understood that the methods and boring heads according to the present invention can be used for horizontally boring beneath any such barriers for installing a pipeline.

FIG. 1

FIG. 1 illustrates the step of drilling a pilot bore 12. In preparing for drilling the pilot bore 12 under the barrier 10, a first pipeline trench 14 is opened on one side of the barrier 10. In addition, a second pipeline trench 16 is opened on the opposite side of the barrier 10 along the proposed path for a pipeline. The first and second pipeline trenches 14 and 16 are dug to the appropriate depth for placement of a pipeline section under the barrier 10. It is to be understood, of course, the references to "first" and "second" pipeline trenches are arbitrary.

Once the first and second pipeline trenches 14 and 16 are opened, the step of drilling the pilot bore 12 is accomplished by using a conventional horizontal drilling rig 18. Horizontal drilling rig 18 can be a horizontal earth boring machine of the type manufactured by American Augers, Model No. 36-600 for 36 inch pipe. It is to be understood that other types of boring machines could be used. Drilling rig 18 has a powered rotator for use in rotating a drill pipe 20 carrying a drill bit. The term "rotator" as used herein means any and all devices causing rotation of a drill pipe. As used herein, the drill pipe 20 can be any suitable drive shaft for use in transferring rotational motion from the drilling rig 18 for use in the boring operation.

Drilling rig 18 also is mounted on or includes an advancer for horizontally advancing the drilling operation. For example, the rig 18 can be mounted on tracks 22 that allow the entire rig to move horizontally to advance the drilling operation. As used herein, the term "advancer" means any and all devices for causing the drilling or boring operation to be advanced in a horizontal direction.

Drilling the pilot bore 12 can be accomplished by rotating and horizontally advancing a drill pipe 20 with a conventional drilling bit. For example, shown in FIG. 1, the drill pipe 20 has a threaded connector 24 at the forward end thereof. A drilling bit 26 is connected to the drill pipe 20 and is rotated and horizontally advanced by the drilling rig 18 during the step of drilling the pilot bore 12. Drilling bit 26 forms the desired pilot bore 12 from the first trench 14 to the second trench 16 beneath the barrier 10. It is to be understood, of course, that the step of drilling the pilot bore 12 can proceed in either direction from one side of the barrier 10 to the other.

During the drilling operation, the drill pipe 20 and drilling bit 26 are supplied with a drilling fluid, commonly referred to as drilling mud. The type of drilling fluid used is not critical to the practice of the invention. For example, drilling fluid pump 28 can be operative connected to a drilling fluid tank 30. The pump 28 and tank 30 can be a moved on a trailer 32. The pump 28 is operatively connected through a suitable flexible tubing 34 to a rotatable coupling 36 on the drill pipe 20. The drill pipe 20 has an axial passageway therethrough for the drilling fluid. Thus, pump 28 can pump drilling fluid from the tank 30, through flexible tubing 34, the rotatable coupling 36, and into the drill pipe 20. Drill pipe 20 spins within a sliding seal in the coupling 36 while drilling fluid is pumped into and through drill pipe 20 to drilling bit 26. One or more small ports (not shown) formed at the forward end of the drill pipe 20 or in the drilling bit 26 deliver the drilling fluid to the exterior of the drilling bit 26. The flowing drilling mud cools the drilling bit 26 and aids in lubricating the cutting of the earth and rock to form the pilot bore 12.

The diameter of the pilot bore 12 is normally relatively small compared to the diameter of the pipeline section that is to be installed under the barrier 10. For example, a typical pilot bore 12 is 8 inches in diameter. The particular size of the pilot bore is not critical, but it is important that the drilling bit 26 be small enough so that a sufficiently stiff drill pipe 20 can be utilized to cut through any rock "R" encountered under the barrier 10 while maintaining a straight bore. The relatively small diameter of the drilling bit 26 results in relatively small twisting forces during the drilling operation such that it is easier to form a straight pilot bore 12 beneath the barrier 10.

The drill pipe 20 is coupled to the drilling rig 18 for rotation as shown by arrow "A". However, the direction of rotation, whether clockwise or counterclockwise, is not critical to the drilling operation. When connected to the drill pipe 20, the drilling bit 26 is designed to rotate with the drill pipe 20.

The drill pipe 20 and drilling bit 26 can be selectively moved or advanced in the forward and reverse direction of arrow "B" during boring. During the drilling operation, the drilling bit 26 is carefully advanced horizontally in the direction of arrow "B" to advance from trench 14 toward trench 16.

Upon reaching the second trench 16, the pilot bore 12 is completed and the drilling bit 26 is removed from the drill pipe 20.

FIG. 2

Figure 2:
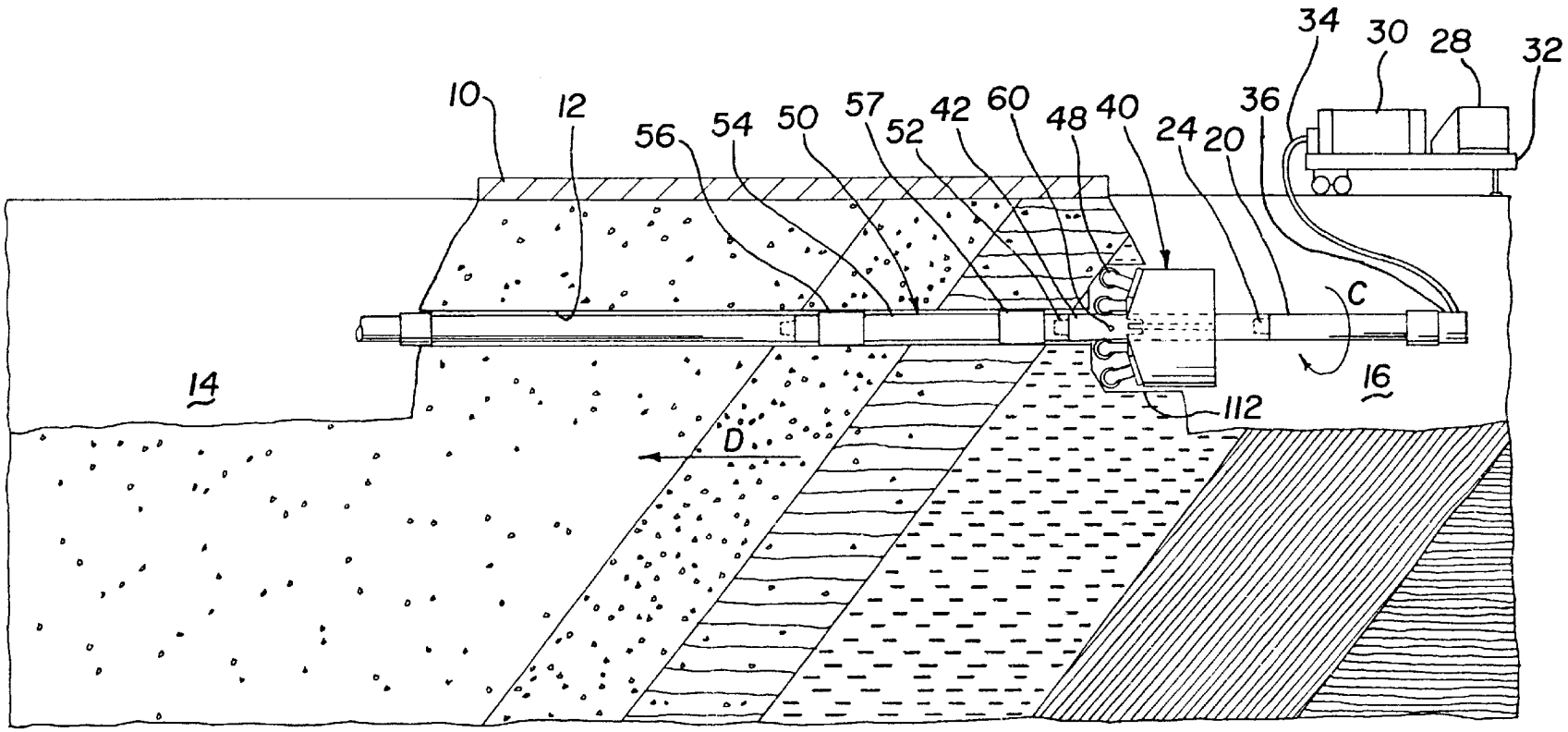
FIG. 2 is a schematic view illustrating the step of enlarging the pilot bore to an intermediate size bore using a cylindrical guide in the pilot bore to guide the boring head while supplying drilling mud to the boring head.

FIG. 2 illustrates the step of enlarging the pilot bore 12 to a secondary bore 112 having a larger diameter than the pilot bore 12. A drilling rig is not shown in FIG. 2, however, the drill pipe 20 is operatively connected to a drilling rig positioned in the second pipeline trench 16, similar to the situation previously described with respect to FIG. 1. Similarly, the drilling fluid pump 28, drilling fluid tank 30, and flexible tubing 34 are operatively connected to a rotatable coupling 36 as previously described with respect to FIG. 1. According to the invention, an improved boring head 40 is connected at the threaded connector 24 to the drill pipe 20.

Presently most preferred embodiments for the boring head 40 will hereinafter be described in detail. In general, however, as shown in FIG. 2, the boring head 40 has an axial member 42, which is preferably tubing with a flow conduit therethrough for drilling fluid. The boring head 40 is structurally supported by the axial member 42. The axial member 42 also is used to connect the boring head 40 at the threaded connector 24 to the drill pipe 20. As will hereinafter be described in detail, the improved boring head 40 has a plurality of cutting cones 48 to cut through the rock and soil located below the barrier 10. The cutting cones 48 are mounted to independently rotate on the boring head 40. As will hereinafter be described in detail, the improved boring head 40 assists in maintaining a straight and centered boring direction even when hard rock is encountered in the boring process.

In addition, a guide assembly 50 is connected at threaded connector 52 to the forward end of axial member 42 of boring head 40. Presently most preferred embodiments for the guide assembly 50 will hereinafter be described in detail. In general, however, as shown in FIG. 2, the guide assembly 50 preferably includes a tubular member 54 with a cylindrical wear plate 56 and cylindrical guide 57 mounted thereon. As shown in FIG. 2, the cylindrical guide 57 is positioned in advance of the boring head 40 and is selected to be of a size to fit in and be guided by the walls of pilot bore 12. Guide 57 preferably also acts as a dam or seal on the walls of the pilot bore 12 to prevent the drilling fluid supplied to the boring head 40 from flowing forward through the pilot bore 12.

Enlarging the pilot bore 12 to the secondary bore 112 can be accomplished by rotating and horizontally advancing the drill pipe 20 with the improved boring head 40 connected thereto. Boring head 40 enlarges the pilot bore 12 from the second trench 16 to the first trench 14 beneath the barrier 10. As the boring head 40 is advanced, the guide assembly 50 steers the boring head 40 along the path of the pilot bore 12. It is to be understood, of course, that the step of enlarging the pilot bore 12 can proceed in either direction from one side of the barrier 10 to the other.

During the drilling operation, the drill pipe 20 and boring head 40 are supplied with a drilling fluid. The type of drilling fluid used is not critical to the practice of the invention. As previously described, pump 28 pumps drilling fluid from the tank 30, through flexible tubing 34, the rotatable coupling 36, and into the drill pipe 20. One or more small ports 60 that are preferably formed in the axial member 42 of the boring head 40 deliver the drilling fluid to the region of the cutting cones 48. The flowing drilling mud cools the cutting cones 48 of the boring head 40 and aids in lubricating the cutting of the earth and rock to enlarge the pilot bore 12 to the desired secondary bore 112.

The drill pipe 20 is coupled to a drilling rig for rotation as shown by arrow "C". However, the direction of rotation, whether clockwise or counterclockwise, is not critical to the drilling operation. When connected to the drill pipe 20, the boring head 40 is designed to rotate with the drill pipe 20 and enlarge the pilot bore 12.

The drill pipe 20 and boring head 40 can be selectively moved or advanced in the forward and reverse direction of arrow "D" during boring. During the drilling operation, the boring head 40 is carefully advanced horizontally in the direction of arrow "D" to advance from second trench 16 toward first trench 14.

Upon reaching the first trench 14, the secondary bore 112 is completed and the boring head 40 is removed from the drill pipe 20. It is to be understood, of course, that the step of enlarging the pilot bore 12 to the larger-diameter secondary bore 112 can proceed in either direction from one side of the barrier 10 to the other.

FIG. 3

Figure 3:
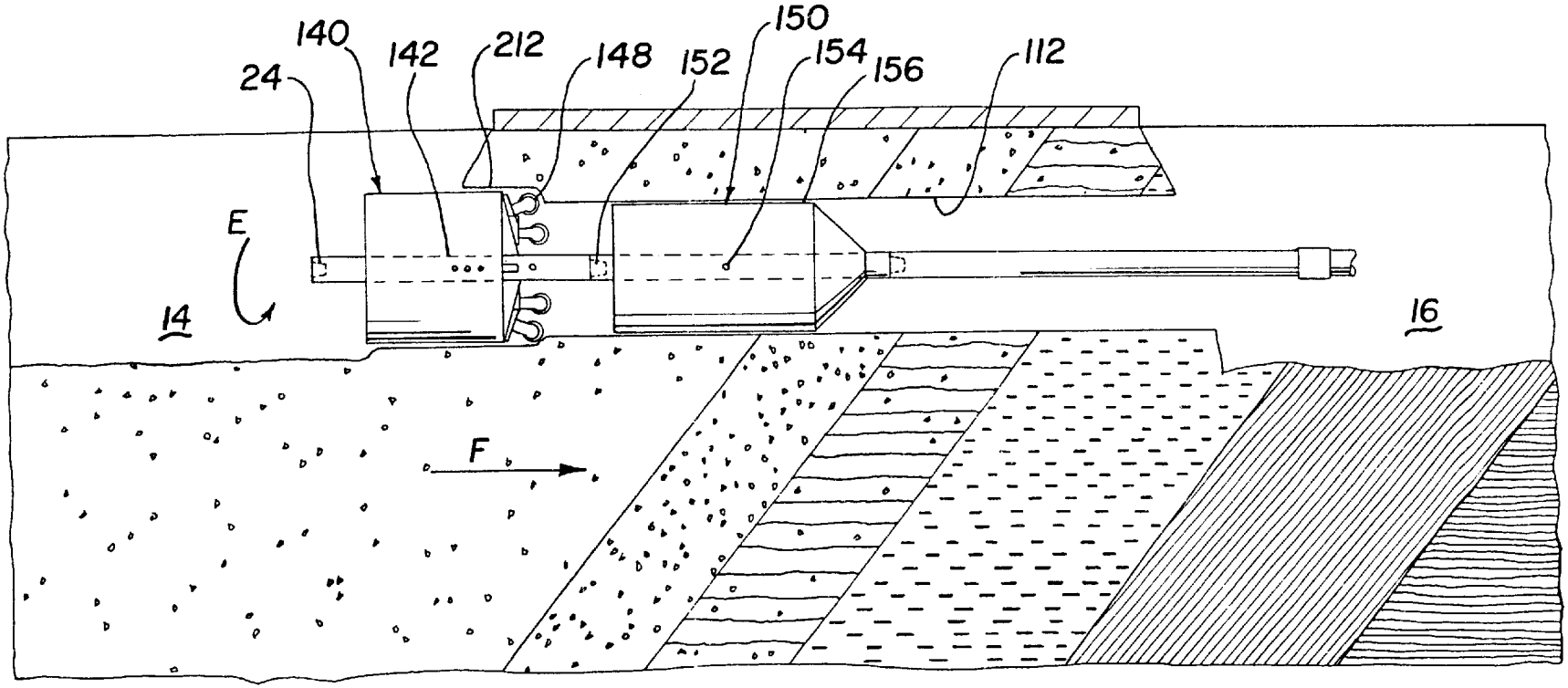
FIG. 3 is a schematic view illustrating another step of enlarging an intermediate size bore to a large bore using a cylindrical guide in the intermediate size bore to guide the boring head while supplying drilling mud to the boring head.

FIG. 3 illustrates an additional step to further enlarge the secondary bore 112 to a tertiary bore 212 having a still larger diameter than the secondary bore 112. In such a situation, the secondary bore 112 is used as a pilot bore for a still larger boring head. For example, to install a 60-inch pipeline, the relatively small pilot bore 22 must usually be opened up to at least one intermediate or secondary bore diameter. If very hard rock is encountered, it may be necessary to use several stepwise drilling operations to open up the pilot bore to successively larger and larger diameter bores until the desired diameter is achieved. For example, the pilot bore may be first enlarged to 24 inches, then in a second drilling operation be enlarged to about 42 inches, and finally in a third drilling operation enlarged to 60 inches.

A drilling rig is not shown in FIG. 3, however, the drill pipe 20 is operatively connected to a drilling rig positioned in the first pipeline trench 14, similar to the situation previously described with respect to FIG. 1. Similarly, a drilling fluid pump, a drilling fluid tank, and a flexible tubing are operatively connected to a rotatable coupling on the drill pipe 20 as previously described with respect to FIG. 1. According to the invention, another example of an improved boring head 140 is connected at the threaded connector 24 to the drill pipe 20.

Presently most preferred embodiments for the boring head 140 will hereinafter be described in detail. In general, however, as shown in FIG. 3, the boring head 140 has an axial member 142, which is preferably tubing with a flow conduit therethrough for drilling fluid. The boring head 140 is structurally supported by the axial member 142. The axial member 142 also is used to connect the boring head 140 at the threaded connector 24 to the drill pipe 20.

As will hereinafter be described in detail, the improved boring head 140 has a plurality of cutting cones 148 to cut through the rock and soil located below the barrier.

The cutting cones 148 are mounted to independently rotate on the boring head 140. As will hereinafter be described in detail, the improved boring head 140 assists in maintaining a straight and centered boring direction even when hard rock is encountered in the boring process.

In addition, a guide assembly 150 is connected at threaded connector 152 to the forward end of axial member 142 of boring head 140. Presently most preferred embodiments for the guide assembly 150 will hereinafter be described in detail. In general, however, as shown in FIG. 3, the guide assembly 150 preferably includes a tubular member 154 with a cylindrical guide 156 mounted thereon. As shown in FIG. 3, the cylindrical guide 156 is positioned in advance of the boring head 140 and is selected to be of a size to fit in and be guided by the walls of secondary bore 112. Guide 156 preferably also acts as a dam or seal on the walls of the secondary bore 112 to prevent the drilling fluid supplied to the boring head 140 from flowing forward through the secondary bore 112.

Enlarging the secondary bore 112 to the tertiary bore 212 can be accomplished by rotating and horizontally advancing the drill pipe 20 with the improved boring head 140 connected thereto. Boring head 140 enlarges the secondary bore 112 from the first trench 14 to the second trench 16 beneath the barrier 10. As the boring head 140 is advanced, the guide assembly 150 steers the boring head 140 along the path of the secondary bore 112. It is to be understood, of course, that the step of drilling the tertiary bore 212 can proceed in either direction from one side of the barrier 10 to the other.

During the drilling operation, the drill pipe 20 and boring head 140 are supplied with a drilling fluid. The type of drilling fluid used is not critical to the practice of the invention. As previously described, pump 28 pumps drilling fluid from the tank 30, through flexible tubing 34, the rotatable coupling 36, and into the drill pipe 20. One or more small ports (not shown in FIG. 3) that are preferably formed in the axial member 142 of the boring head 140 deliver the drilling fluid to the region of the cutting cones 148. The flowing drilling mud cools the cutting cones 148 of the boring head 140 and aids in lubricating the cutting of the earth and rock to enlarge the secondary bore 112, which functions as a pilot bore for this successive drilling step, to the desired tertiary bore 212.

The drill pipe 20 is coupled to a drilling rig for rotation as shown by arrow "E". However, the direction of rotation, whether clockwise or counterclockwise, is not critical to the drilling operation. When connected to the drill pipe 20, the boring head 140 is designed to rotate with the drill pipe 20 and enlarge the secondary bore 112.

The drill pipe 20 and boring head 140 can be selectively moved or advanced in the forward and reverse direction of arrow "F" during boring. During the drilling operation, the boring head 140 is carefully advanced horizontally in the direction of arrow "F" to advance from first trench 14 toward second trench 16.

Upon reaching the second trench 16, the tertiary bore 212 is completed and the boring head 140 is removed from the drill pipe 20. It is to be understood, of course, that the step of enlarging the secondary bore 112 to the larger-diameter tertiary bore 212 can proceed in either direction from one side of the barrier 10 to the other.

Once the desired diameter for the enlarged tertiary bore 212 has been achieved, by one or more stepwise drilling operations, the enlarged bore 212 remains substantially filled with drilling mud and cuttings from the previous boring operations. A pipeline section is floated in the drilling mud from one of the trenches 14 or 16 and into the tertiary bore 212. Finally, once the pipeline section is in position, the drilling mud is pumped out of the section, the pipeline section can be connected to the pipeline and tested for integrity against leaks.

Figure 4:
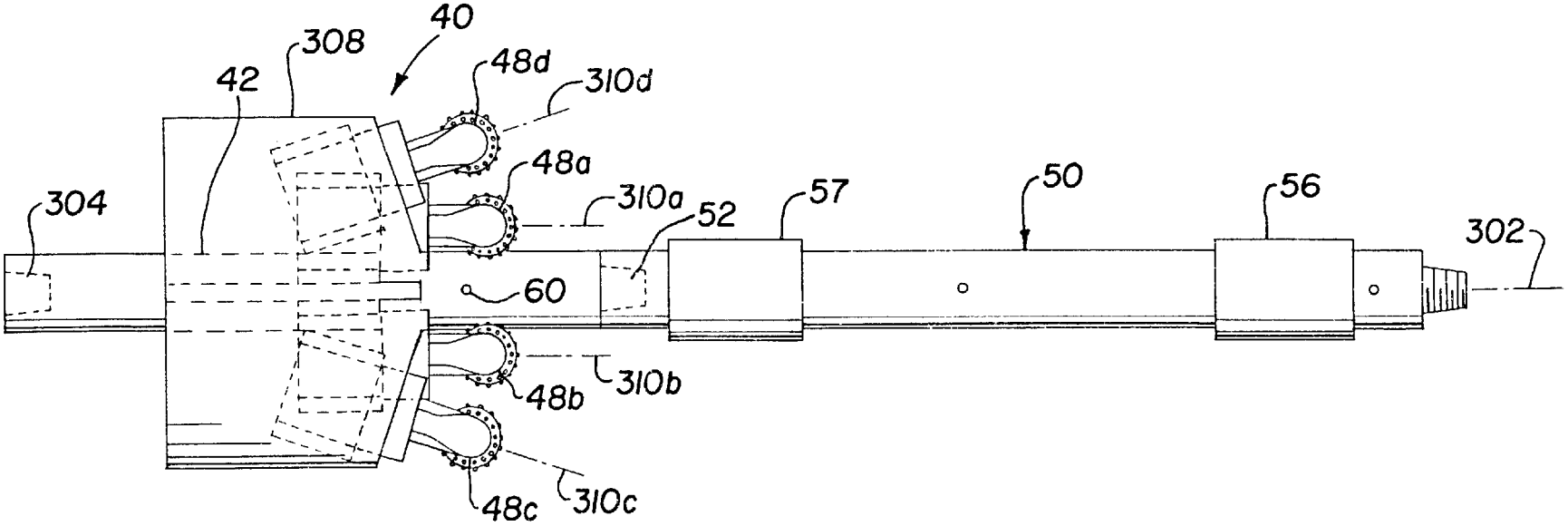
FIG. 4 cross-sectional view illustrating a boring head according to the invention for enlarging a relatively small pilot bore.
Figure 5:
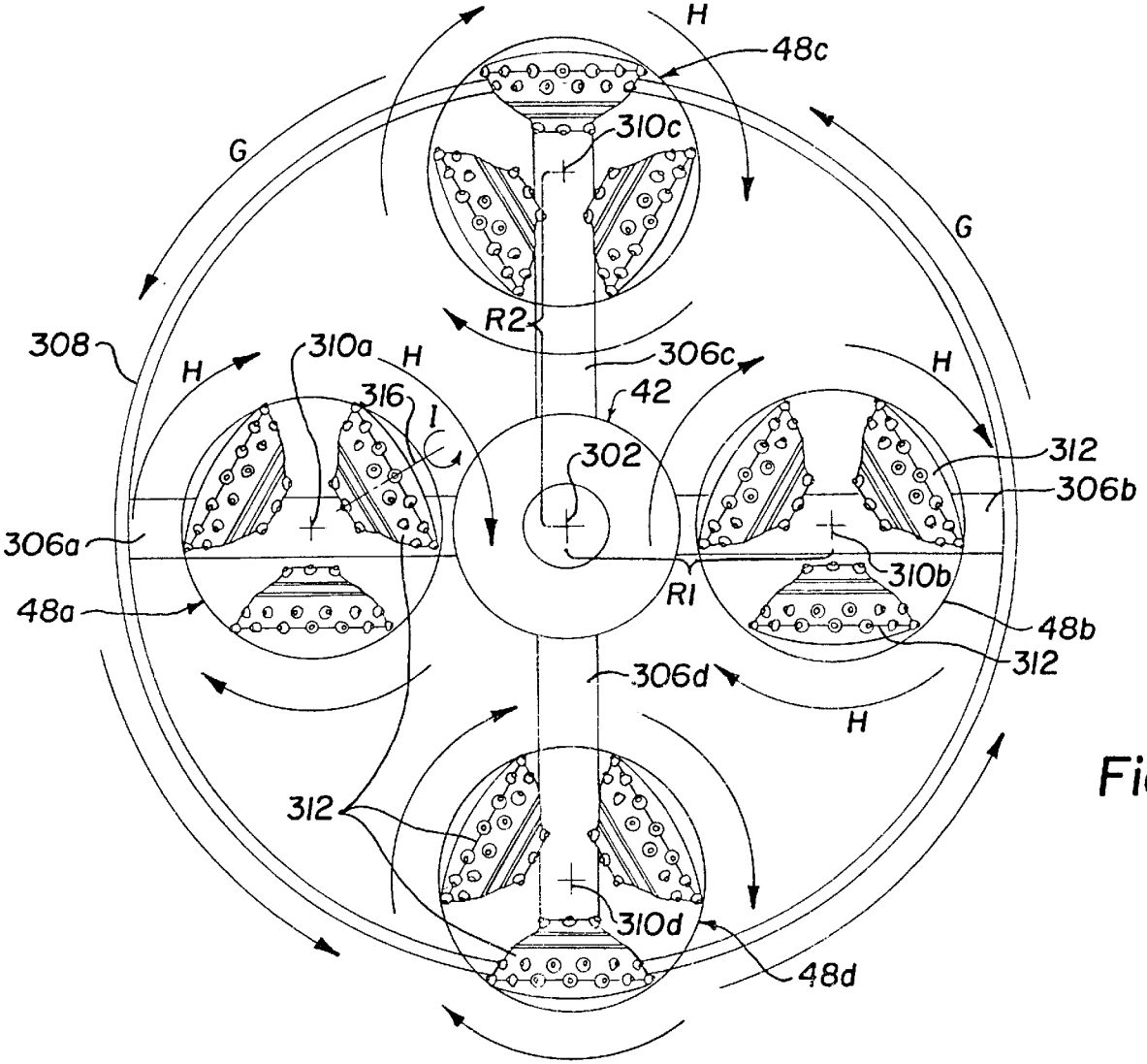
FIG. 5 is a front view of the boring head shown in FIG. 5, showing a presently preferred example for the arrangement of cutting cones on a boring head.

FIGS. 4 and 5

FIGS. 4 and 5 illustrate a first example of a pipeline boring head 40 according to a presently preferred embodiment of the invention. The boring head 40 is an example of a 32-inch diameter boring head for use with an 8 and ¾ inch centering guide 50. For drilling, the boring head 40 is rotated about a central axis 302.

Pipeline boring head 40 has an axial member 42. The axial member 42 is for connecting the boring head 40 to the drill pipe of a drilling rig. The axial member 42 is preferably a tubular member. In the presently most preferred embodiment of the invention, the axial member 42 has a first threaded connector 304 for connecting the axial member 42 to the drill pipe of a drilling rig. It is to be understood, of course, that other types of connectors can be used, or that the axial member 42 can be integrally formed on a drill pipe section. In addition, as shown in FIG. 5, the axial member 42 preferably has an axial flow passage therethrough for transferring a drilling fluid therethrough. As shown in FIG. 4, the axial member 42 preferably has at least one port 60 for delivering the drilling fluid into the boring region of the plurality of cutting cones 48.

The guide assembly 50 is connected at threaded connector 52 to the forward end of axial member 42 of boring head 40. As previously described, the guide assembly 50 can be positioned in a pilot bore for steering the boring head along the axis of the pilot bore.

Referring again to FIG. 5, a plurality of flanges, such as the four flanges 306*a*, 306*b*, 306*c*, and 306*d*, extend radially from the axial member 42. Flanges 306*a–d* are appropriately radially spaced apart from each other as shown. Additional or fewer flanges may be appropriate depending on the size of the boring head. For example, a 36-inch boring head can have four such flanges 306*a–d*, whereas a 60-inch boring head preferably has eight such flanges as hereinafter described in detail. A flange support frame 308 helps support and interconnect the flanges 306*a–d*. While the flange support frame 308 is most preferably in the form of a cylindrical body, it is to be understood that non-circular struts or other members for rigidly interconnecting the flange members 306*a–d* can be used. Thus, the axial member 42, the interconnected flanges 306*a–d*, and the flange support frame 308 provide a rigid structural framework for the boring head 40.

A plurality of cutting cones, such as cutting cones 48*a*, 48*b*, 48*c*, and 48*d*, are mounted to the flanges 306*a–d* of the boring head 40. As shown in FIG. 5, each of the cutting cones 48*a–d* has a cone axis 310*a–d*, respectively, and each of the cutting cones 48*a–d* is mounted the flanges 306*a–d* such that its cone axis 310*a–d*, respectively, extends at an acute angle of from zero degrees up to about 45 degrees relative to the central axis 302 of the boring head 40. According to the presently most preferred embodiment, when the acute angle is greater than zero, it diverges relative to the forward, boring direction of the boring head as shown.

For example, as shown in FIG. 4, cutting cones 48*a* and 48*b* are mounted such that their cone axes 310*a* and 310*b*, respectively, are substantially parallel to the central axis 302 of the boring head 40. According to the presently most preferred embodiment of the boring head 40, the cutting cones 48*c* and 48*d* are mounted such that their cone axes 310*c* and 310*d*, respectively, are at an acute angle of about 30 degrees relative to the central axis 302 of the boring head 40.

As will hereinafter be described in detail, each of the cutting cones 48*a–d* is mounted for independent rotation about its respective cone axis 310*a–d*, and each of the cutting cones 48*a–d* has a plurality of independently rotatable cutter bits 312 mounted thereto. According to the presently most preferred embodiment of the invention, each of the cutting cones 48 has three independently rotatable cutter bits 312. The cutter bits 312 are mounted to independently rotate about bit axes 316 that are substantially perpendicular to the cone axes 310*a–d*.

Thus, as shown in FIG. 5, when the boring head 40 is rotated in the counterclockwise direction of arrows "G" about central axis 302 when looking at its forward end as shown in the drawing, and when the independently mounted cutting cones 48*a–d* engage earth or rock during boring, the counter-forces generated in the boring operation cause the cutting cones 48*a–d* to rotate in the opposite, clockwise directions indicated by arrows "H" about the individual cone axes 310*a–d*, respectively. As the cutting cones 48*a–d* rotate in the directions indicated by arrows "H", the individual cutter bits 312 independently rotate about their respective axis 316 in directions represented by arrow "I", as illustrated for one of the cutter bits 312 of the cutting cone 48*a*. Accordingly, everything rotates: as the boring head 40 is rotated in the direction of arrows "G", the individually mounted cutting cones 48*a–d* rotate in the direction of arrows H, and finally, the individually mounted cutter bits 312 rotate about their respective axes 316 in the directions indicated by arrows "I". The inventive arrangement of a plurality of independently rotatable cutting cones 48*a–d*, each having a plurality of independently rotatable cutter bits 312 provides an increased evenness in the boring operation and produces fine cuttings easily transported out of the way by the drilling fluid.

According to a further aspect of the invention, the cone axis of at least one of the cutting cones is mounted a first radial distance from the central axis, and the cone axis of at least a second one of the cutting cones is mounted a second radial distance from the central axis, whereby as the boring head is rotated, the first and second cutting cones rotate about different radii relative to the central axis. In the presently most preferred embodiment illustrated in FIG. 5, the cutting cones 48*a* and 48*b* are mounted such that the cone axes 310*a* and 310*b*, respectively, are a first radial distance "R1" from the central axis 302, and the cutting cones 48*c* and 48*d* are mounted such that the cone axes 310*c* and 310*d*, respectively, are a second radial distance "R2" from the central axis 302.

Furthermore, the first radial distance "R1" is preferably selected such that the arcuate cutting swath defined by cutting cones 48*a–b* rotating about the central axis 302 of the boring head 40 overlaps with the diameter of the pilot bore for which the boring head 40 is particularly adapted. Thereby, the cutting swath engages at least a portion of the wall of the pilot bore. For example, the first radial distance "R1" can be selected to be substantially equal to the radius of the pilot bore. For larger boring heads or for use in drilling through harder rock, however, the first radial distance "R1" can be selected to cause less overlap with the walls of the pilot bore, thereby reducing the drilling stresses on these cutting cones.

The second radial distance "R2" is preferably greater than "R1" and most preferably is selected such that the arcuate cutting swath defined by rotating the cutting cones 48*c–d* about the central axis 302 overlaps with the cutting swath defined by the rotation of the cones 48*a–b*.

FIGS. 6–8

Figure 8:
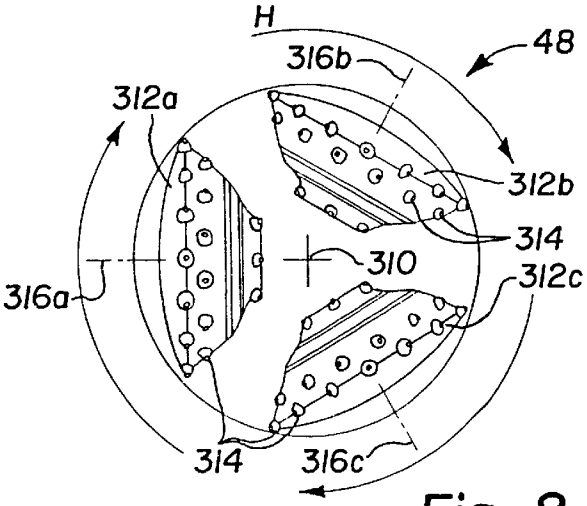
FIG. 8 is a front end view of the cutting cone shown in FIG. 6.
Figure 6:
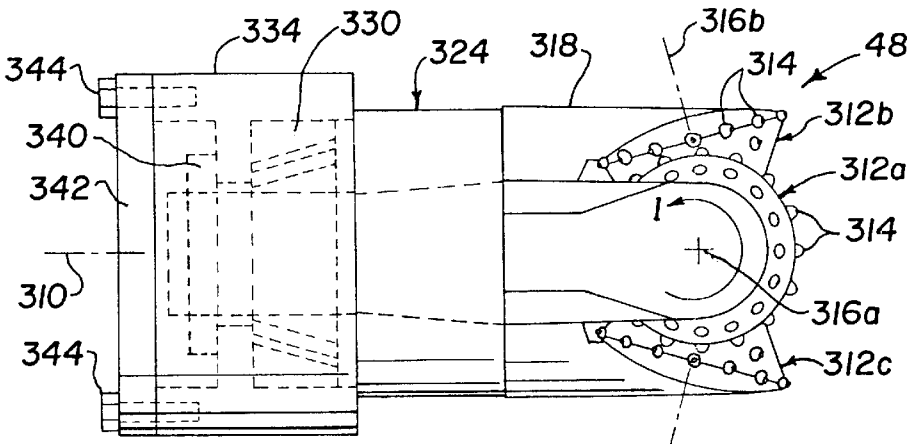
FIG. 6 is a detail of the presently most preferred embodiment of a cutting cone for a boring head according to the invention.
Figure 7:
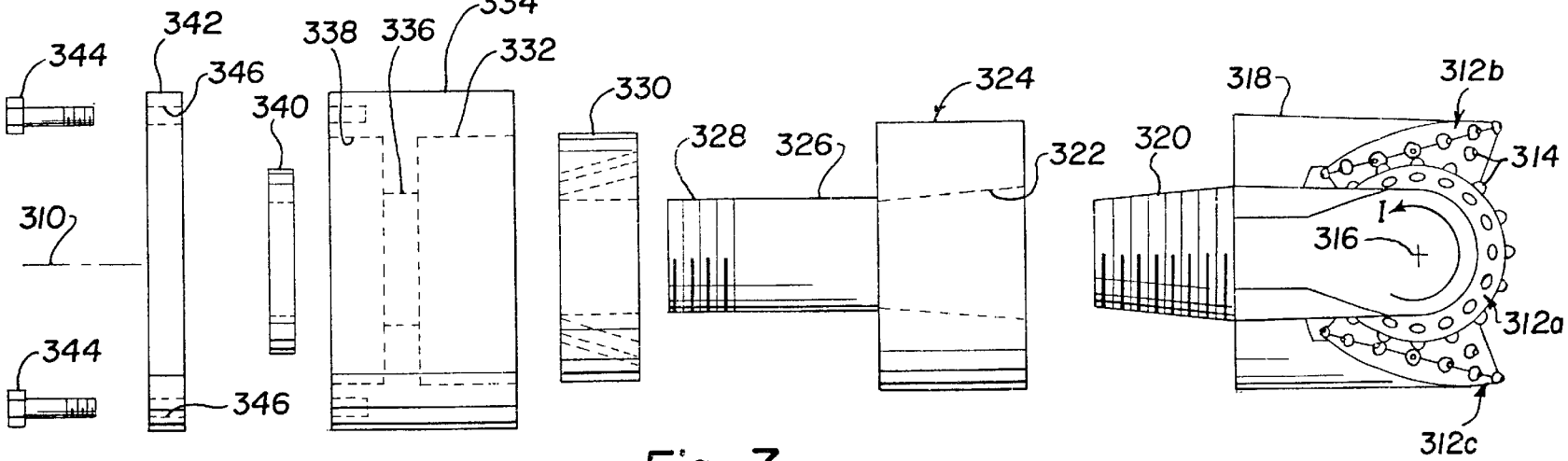
FIG. 7 is an exploded detail of the cutting cone shown in FIG. 6.

Referring now to FIGS. 6–8, a presently most preferred embodiment for a representative cutting cone 48 is shown in more detail. As shown, the cutting cone 48 is mounted for rotation about a cone axis 310.

In particular, a cutting cone 48 preferably includes a plurality of cutter bits 312, and most preferably three cutter bits 312*a–c*. Each of the cutter bits 312*a–c* has a plurality of cutting teeth 314 studded thereon.

The plurality of cutter bits 312*a–c* are mounted for independent rotation about its own axis 316*a–c* on a support stem 318. The support stem 318 is preferably an integrally formed body. As best shown in FIG. 7, the lower end of the support stem 318 has a threaded pin connection 320. The threaded pin connection 320 on the lower end of the support stem 318 is adapted to be received by a corresponding box connector 322 formed in a rotating base 324.

The rotating base 324 has a support shaft 326, which has a threaded end 328 at the lower end thereof. The support shaft 326 of the rotating base 324 extends through a tapered bearing 330. The tapered bearing 330 is adapted to be positioned in a bearing receptacle 332 in a housing 334. The support shaft 326 of the rotating base 324 also extends through a bore 336 formed in the housing 334, such that the threaded end 328 extends into a retaining ring receptacle 338 formed at the distal side of the housing 334. A threaded retaining ring 340 is adapted to be screwed onto the threaded end 328 and the tightened onto the shaft 326 such that the support shaft 326 of the rotating base is captured to rotate on the tapered bearing 330 in the housing 334.

The retaining ring 340 in the retaining ring receptacle 338 is protectively covered by an end cap 342, which is connected to the housing with screws 344 that extend through apertures 346 in the end cap 342 and that are tapped into the housing 334. The housing 334 is integrally formed on or securely attached to one of the flanges of a boring head. Thus, each cutting cone 48 has a easily replaceable cutter bits 312 for changing as required for wear and tear.

FIGS. 9–10

Figure 9:
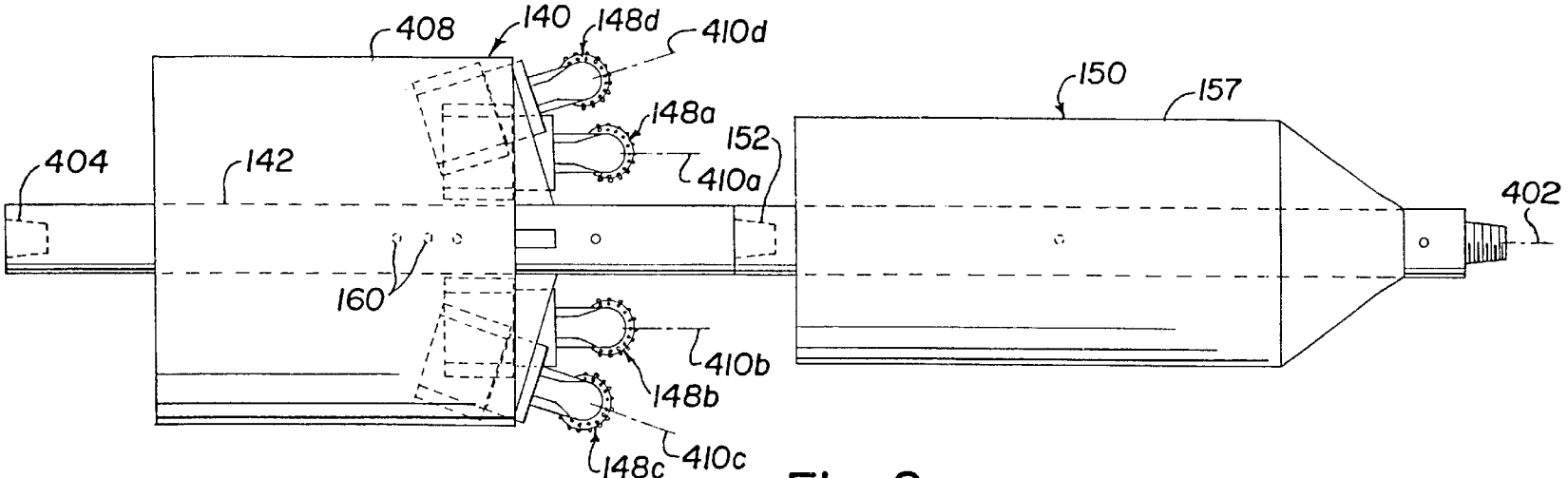
FIG. 9 is a cross-sectional view illustrating a boring head having an enlarged guide for enlarging a relatively large pilot bore.
Figure 10:
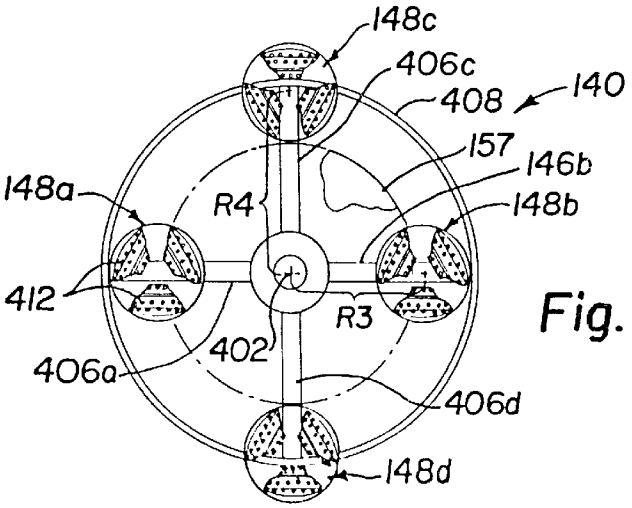
FIG. 10 is a front end view of the boring head shown in FIG. 9, showing a second example of an arrangement of the cutting cones for a boring head according to the invention.

FIGS. 9 and 10 illustrate a example of a pipeline boring head 140 for enlarging a secondary bore according to a presently preferred embodiment of the invention. The boring head 140 is an example of a 42-inch diameter boring head for use with a 24-inch centering guide 150. For drilling, the boring head 140 is rotated about a central axis 402.

Pipeline boring head 140 has an axial member 142. The axial member 142 is for connecting the boring head 140 to the drill pipe of a drilling rig. The axial member 142 is preferably a tubular member. In the presently most preferred embodiment of the invention, the axial member 142 has a first threaded connector 404 for connecting the axial member 142 to the drill pipe of a drilling rig. It is to be understood, of course, that other types of connectors can be used, or that the axial member 142 can be integrally formed on a drill pipe section. In addition, as shown in FIG. 10, the axial member 142 preferably has an axial flow passage therethrough for transferring a drilling fluid therethrough. As shown in FIG. 9, the axial member 142 preferably has at least one port 160 for delivering the drilling fluid into the boring region of the plurality of cutting cones 148.

The guide assembly 150 is connected at threaded connector 152 to the forward end of axial member 142 of boring head 140. As previously described, the guide assembly 150 can be positioned in a secondary bore, which serves a similar function as the initially drilled pilot bore, for steering the boring head 140 along the axis of the secondary bore.

Referring again to FIG. 10, a plurality of flanges, such as the four flanges 406*a*, 406*b*, 406*c*, and 406*d*, extend radially from the axial member 142. Flanges 406*a–d* are appropriately radially spaced apart from each other as shown. Additional or fewer flanges may be appropriate depending on the size of the boring head. For example, a 42-inch boring head can have four such flanges 406*a–d*, whereas a 60-inch boring head preferably has eight such flanges as hereinafter described in detail. A flange support frame 408 helps support and interconnect the flanges 406*a–d*. While the flange support frame 408 is most preferably in the form of a cylindrical body, it is to be understood that non-circular struts or other members for rigidly interconnecting the flange members 406*a–d* can be used. Thus, the axial member 142, the interconnected flanges 406*a–d*, and the flange support frame 408 provide a rigid structural framework for the boring head 140.

A plurality of cutting cones, such as cutting cones 148*a*, 148*b*, 148*c*, and 148*d*, are mounted to the flanges 406*a–d* of the boring head 40. As best shown in FIG. 10, each of the cutting cones 148*a–d* has a cone axis 410*a–d*, respectively, and each of the cutting cones 148*a–d* is mounted the flanges 406*a–d* such that its cone axis 410*a–d*, respectively, extends at an acute angle of from zero degrees up to about 45 degrees relative to the central axis 402 of the boring head 140. According to the presently most preferred embodiment, when the acute angle is greater than zero, it diverges relative to the forward, boring direction of the boring head as shown.

For example, as shown in FIG. 9, cutting cones 148*a* and 148*b* are mounted such that their cone axes 410*a* and 410*b*, respectively, are substantially parallel to the central axis 402 of the boring head 140. According to the presently most preferred embodiment of the boring head 140, the cutting cones 148*c* and 148*d* are mounted such that their cone axes 410*c* and 410*d*, respectively, are at an acute angle of about 30 degrees relative to the central axis 402 of the boring head 140.

The cutting cones 148*a–d* are of similar design and structure as previously described for cutting cone 48. Each of the cutting cones 148*a–d* is mounted for independent rotation about its respective cone axis 410*a–d*, and each of the cutting cones 148*a–d* has a plurality of independently rotatable cutter bits 412 mounted thereto. According to the presently most preferred embodiment of the invention, each of the cutting cones 148*a–d* has three independently rotatable cutter bits 412. The cutter bits 412 are mounted to independently rotate about bit axes that are substantially perpendicular to the cone axes 410*a–d*.

Accordingly, everything rotates on the boring head 140: as the boring head 140 is rotated about the central axis 402, the individually mounted cutting cones 148*a–d* tend to rotate in the opposite direction, and finally the individually mounted cutter bits 412 independently rotate about their respective axes on the cutting cones. The inventive arrangement of a plurality of independently rotatable cutting cones 48*a–d*, each having a plurality of independently rotatable cutter bits 412 provides an increased evenness in the boring operation and produces fine cuttings easily transported out of the way by the drilling fluid.

In the presently most preferred embodiment illustrated in FIG. 10, the cutting cones 148*a* and 148*b* are mounted such that the cone axes 410*a* and 410*b*, respectively, are a first radial distance "R3" from the central axis 402, and the cutting cones 148*c* and 148*d* are mounted such that the cone axes 410*c* and 410*d*, respectively, are a second radial distance "R4" from the central axis 402.

Furthermore, the first radial distance "R3" is preferably selected such that the arcuate cutting swath defined by cutting cones 148*a–b* rotating about the central axis 402 of the boring head 140 overlaps with the diameter of the pilot bore or secondary bore for which the boring head 140 is particularly adapted. Thereby, the cutting swath engages at least a portion of the wall of the pilot bore or secondary bore. For example, the first radial distance "R3" can selected to be substantially equal to the radius of the pilot bore or secondary bore for which the boring head 140 is intended.

The second radial distance "R4" is preferably greater than "R3" and most preferably is selected such that the arcuate cutting swath defined by rotating the cutting cones 148*c–d* about the central axis overlaps with the cutting swath defined by the rotation of the cones 148*a–b*.

Figure 11:
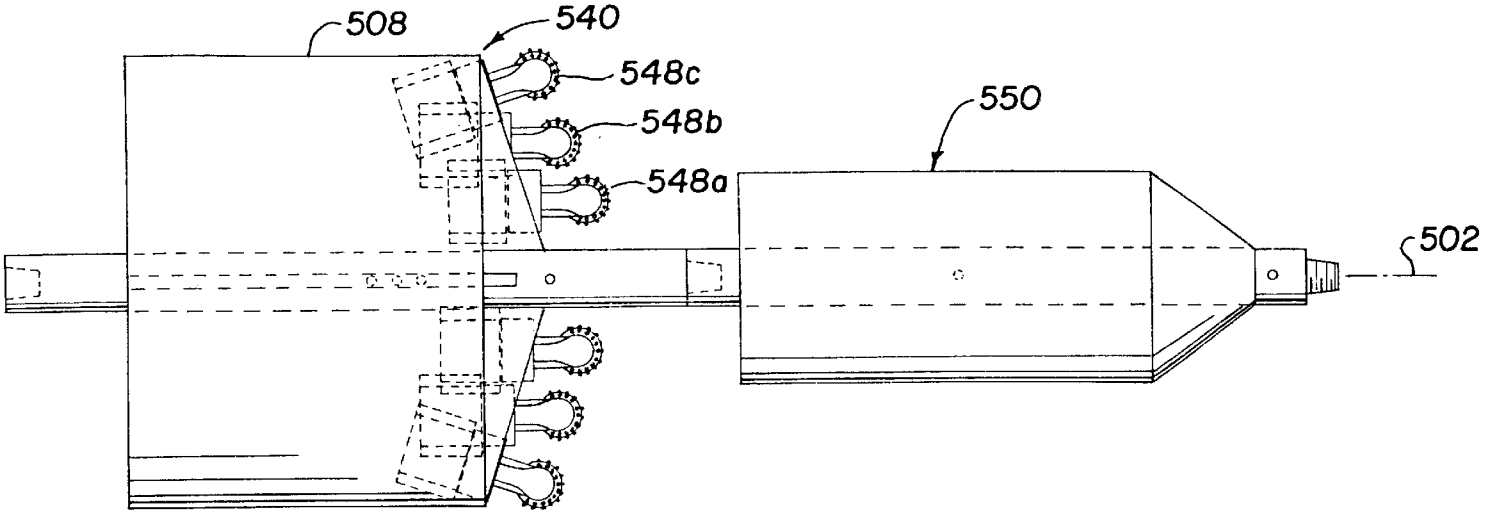
FIG. 11 is a cross-sectional view illustrating an alternative boring head having an enlarged guide for enlarging a relatively large pilot bore.
Figure 12:
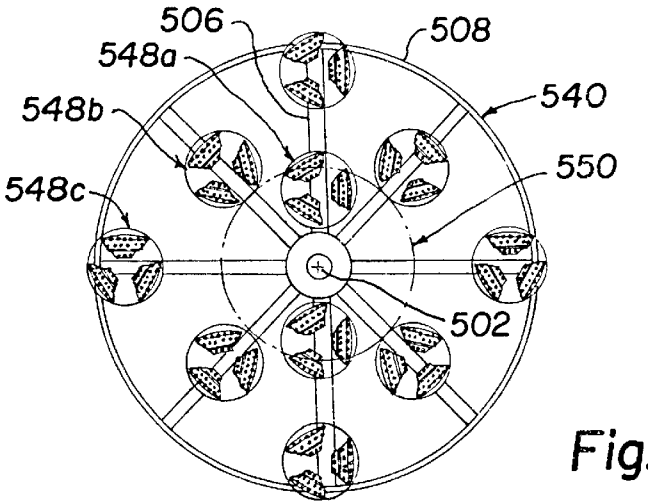
FIG. 12 is a front end view of the boring head shown in FIG. 11, showing an alternative example of an arrangement of the cutting cones for a boring head according to the invention.

FIGS. 11 and 12

FIGS. 11 and 12 illustrate an alternative boring head 540 that can be used for enlarging a secondary bore. Boring head 540 is an example of a 54-inch diameter boring head for use with a 24-inch centering guide 550. Boring head 540 is of substantially similar design to previously discussed boring head 140, except for its dimensions, the number of flanges, and the illustrated variation in the number and arrangement of the cutting cones 548 on the flanges. Cutting cones 548 are of similar design and construction as previously described for cutting cones 48 with reference to FIGS. 6–8.

In particular, as shown in FIG. 12, the boring head 540 is an example of a large-diameter boring head according to the invention having eight flanges 506, that are interconnected by the cylindrical support frame 508.

Also as shown in FIG. 12, the boring head 540 preferably has a first set of two cutting cones 548*a*, a second set of four cutting cones 548*b*, and a third set of four cutting cones 548*c*. The cutting cones 548*a–c* are of the substantially the same design as previously described herein with reference to FIGS. 6–8.

In the presently most preferred embodiment illustrated in FIG. 12, the first set of cutting cones 548*a* are mounted such that their respective cone axes are a first radial distance from the central axis 502, and the second set of cutting cones 548*b* are mounted such that their respective cone axes are a second radial distance from the central axis 502, and the third set of cutting cones 548*c* are mounted such that their respective cone axes are a third radial distance from the central axis 502.

Furthermore, the first radial distance is preferably selected such that the arcuate cutting swath defined by cutting cones 548*a* rotating about the central axis 502 of the boring head 540 overlaps with the diameter of the pilot bore or secondary bore for which the boring head 540 is particularly adapted. Thereby, the cutting swath engages at least a portion of the wall of the pilot bore or secondary bore. For example, the first radial distance can selected to be substantially less than the radius of the pilot bore or secondary bore for which the boring head 540 is intended.

The second radial distance is preferably greater than the first radial distance and most preferably is selected such that the arcuate cutting swath defined by rotating the cutting cones 548*b* about the central axis 502 overlaps with the cutting swath defined by the rotation of the cones 548*a*, and takes a further incremental bite out of the wall of the pilot bore (i.e., a secondary bore functioning as the pilot bore for the successive drilling step). Furthermore, as shown in FIG. 11, the second set of cutting cones 548*b* are preferably set axially back relative to the first set of cutting cones 548*a*. This axially staggered arrangement assists in more evenly distributing the cutting work between the first and second set of cutting cones 548*a* and 548*b*, respectively.

The third radial distance is preferably greater than the second radial distance and most preferably is selected such that the arcuate cutting swath defined by rotating the cutting cones 548*b* about the central axis 502 overlaps with the cutting swath defined by the rotation of the cones 548*b*, and takes a yet another incremental bite out of the wall of the pilot bore or secondary bore. Furthermore, as shown in FIG. 11, the third set of cutting cones 548*c* are preferably set back relative to the second set of cutting cones 548*b*. This axially staggered arrangement assists in more evenly distributing the cutting work between the second and third set of cutting cones 548*b* and 548*c*, respectively.

In addition, the third set of cutting cones 548*c* are preferably mounted on the boring head 540 such that the cone axes for each of these cutting cones is at an angle of about 30 degrees relative to the central axis 502. This angular displacement further assists in more evenly distributing the cutting work between the second and third set of cutting cones 548*b* and 548*c*.

FIG. 13

Figure 13:
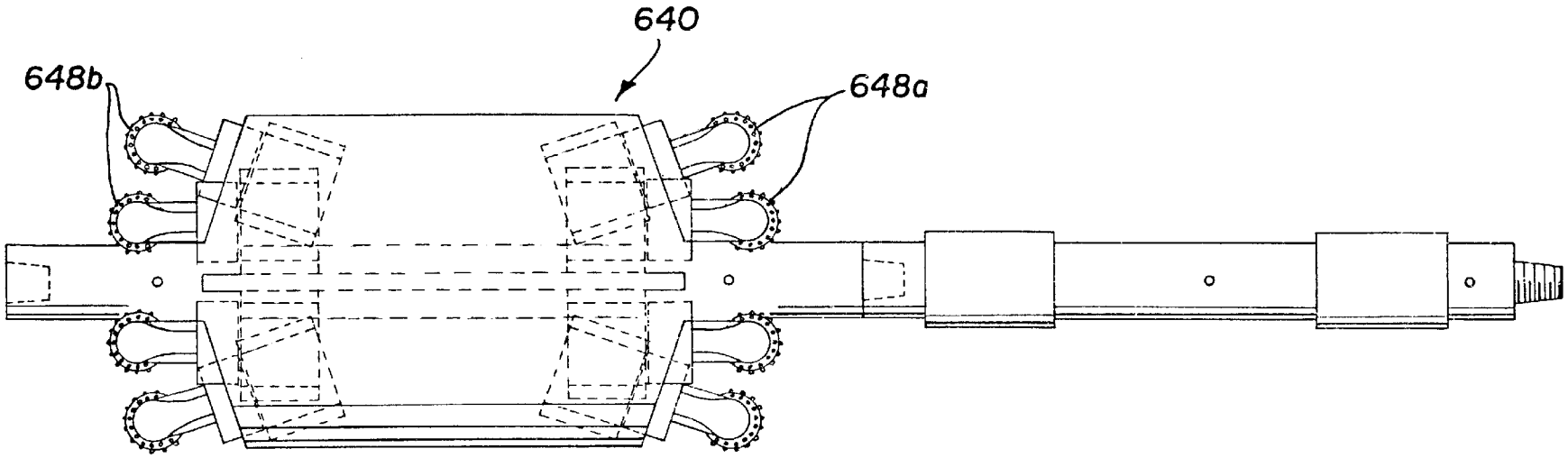
FIG. 13 is a cross-sectional view illustrating an example of a bi-directional boring head according to a further aspect of the invention.

Referring now to FIG. 13 of the drawing, a bi-directional boring head 640 according to a further aspect of the invention is illustrated. The bidirectional boring head 640 is of substantially the same design as previously discussed and illustrated boring head 40, however, as shown in FIG. 13, the boring head 640 has forward facing cutting cones 648*a* and rearward facing cutting cones 648*b*. The rearward facing cutting cones 648*b* provide the additional capability of boring in either direction. The cutting cones 648*a* and 648*b* are of substantially the same design and structure as previously discussed with respect to FIGS. 6–8. Furthermore, the arrangement of the cutting cones 648*a* and 648*b* at either end of the boring head 640 can be made according to the principles of the invention previously discussed herein.

FIGS. 14–16

Figure 14:
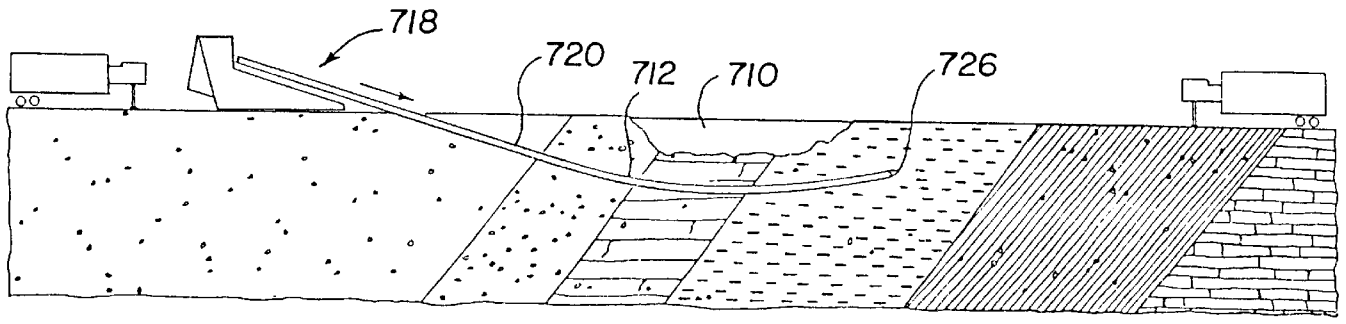
FIG. 14 is a schematic view illustrating a first step of drilling a pilot bore according to an alternative embodiment of the method of making a larger diameter bore for a pipe section under a barrier.
Figure 15:
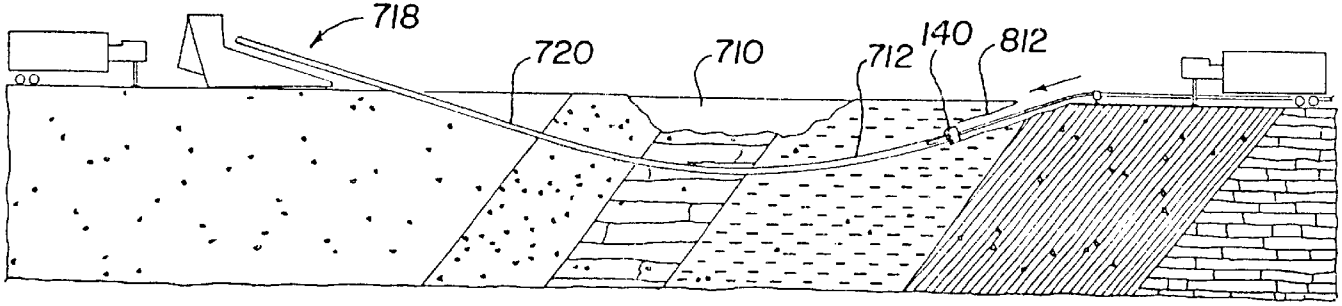
FIG. 15 is a schematic view illustrating the step of enlarging the pilot bore to an intermediate size bore according to an alternative embodiment of the method using a cylindrical guide in the pilot bore to guide the boring head while supplying drilling mud to the boring head.
Figure 16:
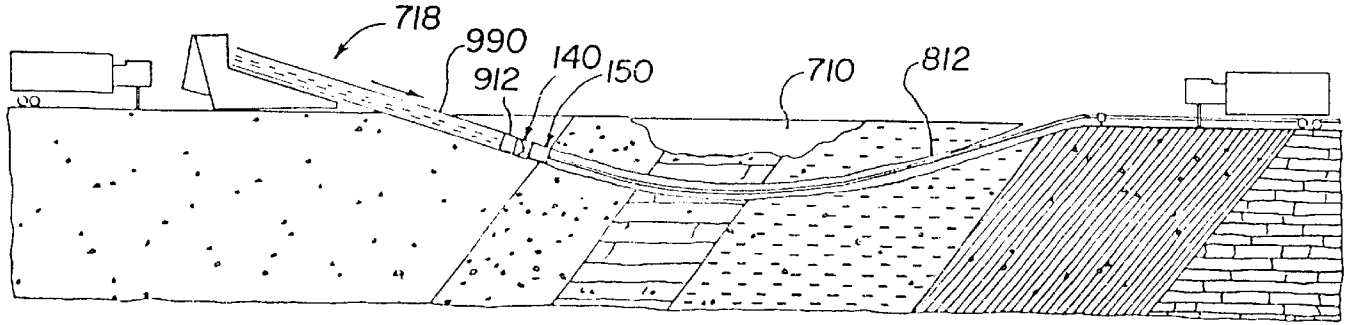
FIG. 16 is a schematic view illustrating another step of enlarging an intermediate size bore to a large bore and installing a pipeline section according to an alternative embodiment of the method using a cylindrical guide in the intermediate size bore to guide the boring head while supplying drilling mud to the boring head.

FIGS. 14–16 illustrate an another presently most preferred embodiment for practicing the present invention. Under a wide barrier, such as a wide river 710, it is possible to install the pipeline along a gently curved path.

FIG. 14 illustrates the step of drilling a curved pilot bore 712. The step of drilling the pilot bore 612 is accomplished by using a conventional horizontal drilling rig 718. Drilling rig 718 has a powered rotator for use in rotating a drill pipe 720 carrying a drill bit. Drilling rig 718 also is mounted on or includes an advancer for horizontally advancing the drilling operation. Drilling the pilot bore 712 can be accomplished by rotating and horizontally advancing a drill pipe 720 with a conventional drilling bit 726. It is to be understood, of course, that the step of drilling the pilot bore 12 can proceed in either direction from one side of the barrier 10 to the other.

During the drilling operation, the drill pipe 720 and drilling bit 726 are supplied with a drilling fluid, commonly referred to as drilling mud. One or more small ports (not shown) formed at the forward end of the drill pipe 720 or in the drilling bit 726 deliver the drilling fluid to the exterior of the drilling bit 726. The flowing drilling mud cools the drilling bit 726 and aids in lubricating the cutting of the earth and rock to form the pilot bore 712.

Upon reaching the opposite side of the river barrier 718, the pilot bore 712 is completed and the drilling bit 726 is removed from the drill pipe 720.

FIG. 15 illustrates the step of enlarging the pilot bore 712 to a secondary bore 112 having a larger diameter than the pilot bore 12. The drill pipe 720 is operatively connected to a drilling rig 718, similar to the situation previously described with respect to FIG. 14. According to the invention, an improved boring head 40 as previously described herein is connected to the drill pipe 720. The improved boring head 40 assists in maintaining a straight and centered boring direction even when hard rock is encountered in the boring process.

Enlarging the pilot bore 712 to the secondary bore 812 can be accomplished by rotating and horizontally advancing the drill pipe 720 with the improved boring head 40 connected thereto. Boring head 40 enlarges the pilot bore 712 from one side of the barrier 710 to the other. As the boring head 40 is advanced, the guide assembly 50 (previously described) steers the boring head 40 along the path of the pilot bore 712. It is to be understood, of course, that the step of enlarging the pilot bore 712 can proceed in either direction from one side of the barrier 710 to the other.

As previously described, during the drilling operation, the drill pipe 720 and boring head 40 are supplied with a drilling fluid. The flowing drilling mud cools the cutting cones of the boring head 40 and aids in lubricating the cutting of the earth and rock to enlarge the pilot bore 712 to the desired secondary bore 812.

As shown in FIG. 15, the boring head 40 can be pulled through the pilot bore 712.

Upon reaching the opposite side of the barrier 710, the secondary bore 812 is completed and the boring head 40 is removed from the drill pipe 720. It is to be understood, of course, that the step of enlarging the pilot bore 712 to the larger-diameter secondary bore 812 can proceed in either direction from one side of the barrier 710 to the other.

FIG. 16 illustrates an additional step to further enlarge the secondary bore 812 to a tertiary bore 912 having a still larger diameter than the secondary bore 812. In such a situation, the secondary bore 812 is used as a pilot bore for a still larger boring head. According to the invention, another example of an improved boring head 140 as previously described herein is connected to the drill pipe 720.

In addition, a guide assembly 150 is connected to the forward end boring head 140. As shown in FIG. 16, the cylindrical guide 150 is positioned in advance of the boring head 140 and is selected to be of a size to fit in and be guided by the walls of secondary bore 112. Guide 150 preferably also acts as a dam or seal on the walls of the secondary bore 812 to prevent the drilling fluid supplied to the boring head 140 from flowing forward through the secondary bore 812.

Enlarging the secondary bore 812 to the tertiary bore 912 can be accomplished by rotating and horizontally advancing the drill pipe 720 with the improved boring head 140 connected thereto. As the boring head 140 is advanced, the guide assembly 150 steers the boring head 140 along the path of the secondary bore 812. It is to be understood, of course, that the step of drilling the tertiary bore 912 can proceed in either direction from one side of the barrier 710 to the other.

During the drilling operation, the drill pipe 20 and boring head 140 are supplied with a drilling fluid. The type of drilling fluid used is not critical to the practice of the invention. The flowing drilling mud cools the cutting cones of the boring head 140 and aids in lubricating the cutting of the earth and rock to enlarge the secondary bore 812, which functions as a pilot bore for this successive drilling step, to the desired tertiary bore 912. It is to be understood, of course, that the step of enlarging the secondary bore 812 to the larger-diameter tertiary bore 912 can proceed in either direction from one side of the barrier 710 to the other.

As the enlarged tertiary bore 912 is being drilled, after one or more previous stepwise drilling operations, the enlarged bore 912 remains substantially filled with drilling mud and cuttings from the previous boring operations. A pipeline section 990 is floated behind the boring head 140 in the drilling mud into the tertiary bore 912. Finally, once the one or more pipeline sections 990 are in position to span the barrier 710, the drilling mud is pumped out of the section(s) and the pipeline section can be connected to the pipeline and tested for integrity against leaks.

FIGS. 17–20

Yet another aspect of the present inventions provides a horizontal boring head with facilitated replacement of rotating cutter bits. These cutter bits are used to bore through rock and frequently work under under highly abrasive conditions. Making a reliable prediction of cutter bit service life is impossible because of the random factors in day to day operations. Thus, field replacement of the rotating cutter bit assemblies often becomes necessary on some jobs and occasionally becomes necessary on others. The cutter bit assemblies are substantial parts, weighing 30 pounds apiece and more, and are awkward to handle. Thus, field replacement can be time consuming and expensive in terms of down-time, especially in situations where the entire crew must stand by and wait.

Figure 17A:
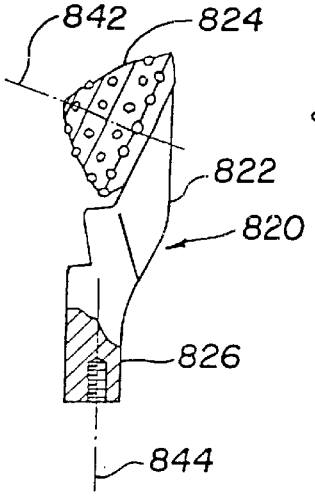
FIG. 17A is a side view of the embodiment of FIG. 17.
Figure 17:
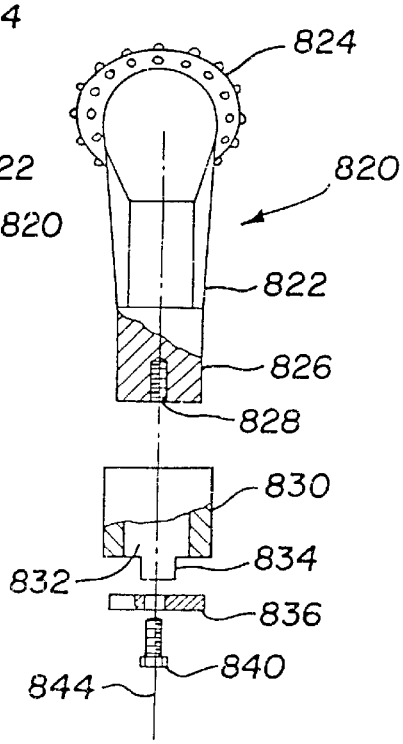
FIG. 17 is an exploded view of a preferred embodiment of the cutter bit assembly of the present inventions.

FIG. 17 shows an exploded view of the installation of rotatable cutter bit assembly 820 and FIG. 17A is a side view of cutter bit assembly 820. Cutter bit body 822 is seen to include externally tapered end portion 826 at one end and rotatable cutter bit 824 at the other. Rotatable cutter bit 824 is mounted to bit body 822 on an unshown bearing system so as to be free to rotate about rolling axis 842. Externally tapered end portion 826 fits tightly into open ended, tapered cavity 832 in pocket 830, wherein it is drawn and retained by the threaded engagement of bolt 840 with hole 828. Washer plate 836 bears the against the end of pocket member 830 to react the pulling force of bolt 840 along longitudinal axis 844. Locking tang 834 is bent to bear against the head of bolt 840 so as to lock it in place after tightening.

It should be noted that working forces applied to rotatable cutter bit 824 also act generally along longitudinal axis 844 and serve to force tapered end portion 826 into cavity 832, so that engagement of these parts is tightened while boring. It is also notable, that rolling axis 842 is preferably disposed at an angle in the range between ten and eighty degrees with respect to longitudinal axis 844.

Figure 18:
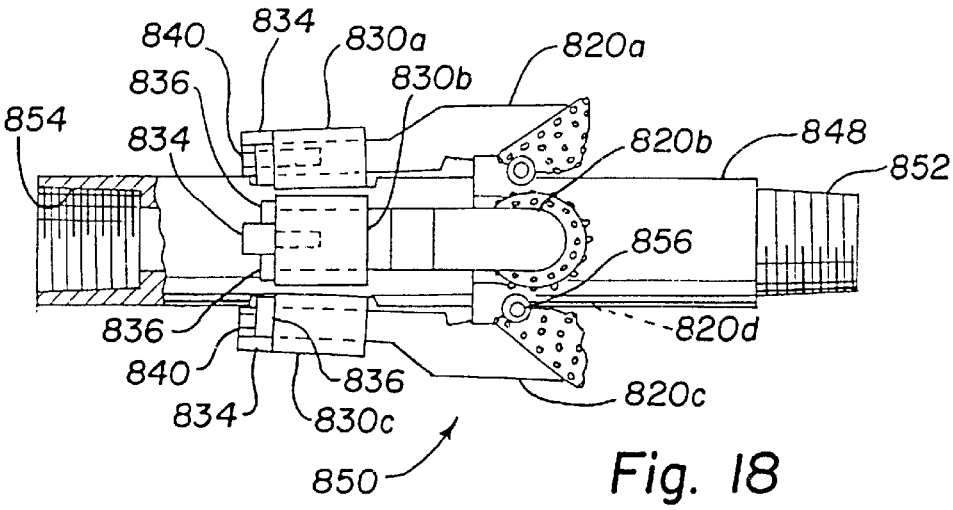
FIG. 18 is a side view of a boring head incorporating the preferred embodiment of FIGS. 17 and 17A.

FIG. 18 shows installation of rotatable cutter bit assemblies 820*a–d*, as shown in FIG. 17, in boring head 850. A convenient length of drill pipe serves as axial central member 848 of boring head 850 and provides drill pipe compatible threaded ends 852 and 854. Previously described open ended, longitudinally tapered pockets 830*a–d* are positioned at ninety degree intervals about the periphery of central member 848 and welded in place. Rotatable cutter bit assemblies 820*a–d* are driven and bolted into tapered pockets 830*a–d*, where they are retained by washer plates 836 and bolts 840. Bolt locking tangs 834 are bent to bear against the heads of bolts 840 after tightening. Drilling mud outlets 856 are arranged to conduct the flow of mud from the interior of axial member 848 across the bore face to carry off cuttings in a manner well known to those skilled in the hole boring arts. Working forces applied to cutter bit assemblies 820*a–d* also act to force the tapered bit bodies into pockets 830*a–d*, so that engagement of these parts is tightened while boring. It is also shown how the longitudinal axis 844 of FIG. 17 will be oriented in a generally parallel relationship with the axis of axial member 848 so that rolling axis 842 of FIG. 17 will be disposed at an angle in the range between ten and eighty degrees with respect to the axis of axial member 848.

Figure 19:
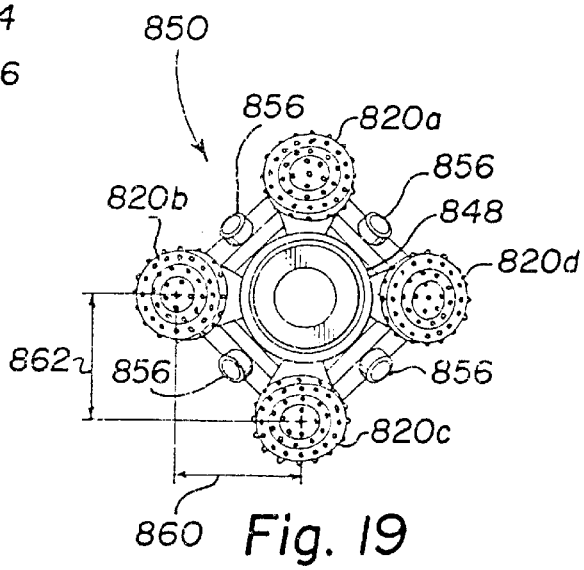
FIG. 19 is an end view of the boring head incorporating the preferred embodiment of FIGS. 17 and 17A.

FIG. 19 shows the working end view of boring head 850. Of particular interest here, is the radial spacing or distance 862 of cutter bit assemblies 820*a* and 820*c* as compared to the radial spacing or distance 860 of cutter bit assemblies 820*b* and 820*d*. Radial spacing dimension 860 is greater than radial spacing 862 so as to cause cutter bit assemblies 820*a* and 820*c* to act along an offset arcuate path with respect to cutter bit assemblies 82*b* and 820*d*. This results in better coverage of the bore face, finer cuttings or chips, and faster progress when boring. Also shown in FIG. 19 are drilling outlets 856 and the manner in which they are located to circulate drilling mud across the bore face for chip removal.

Yet another aspect of the present inventions provides a horizontal boring head with improved guidance and stability for following and enlarging a pilot bore.

Figure 20:
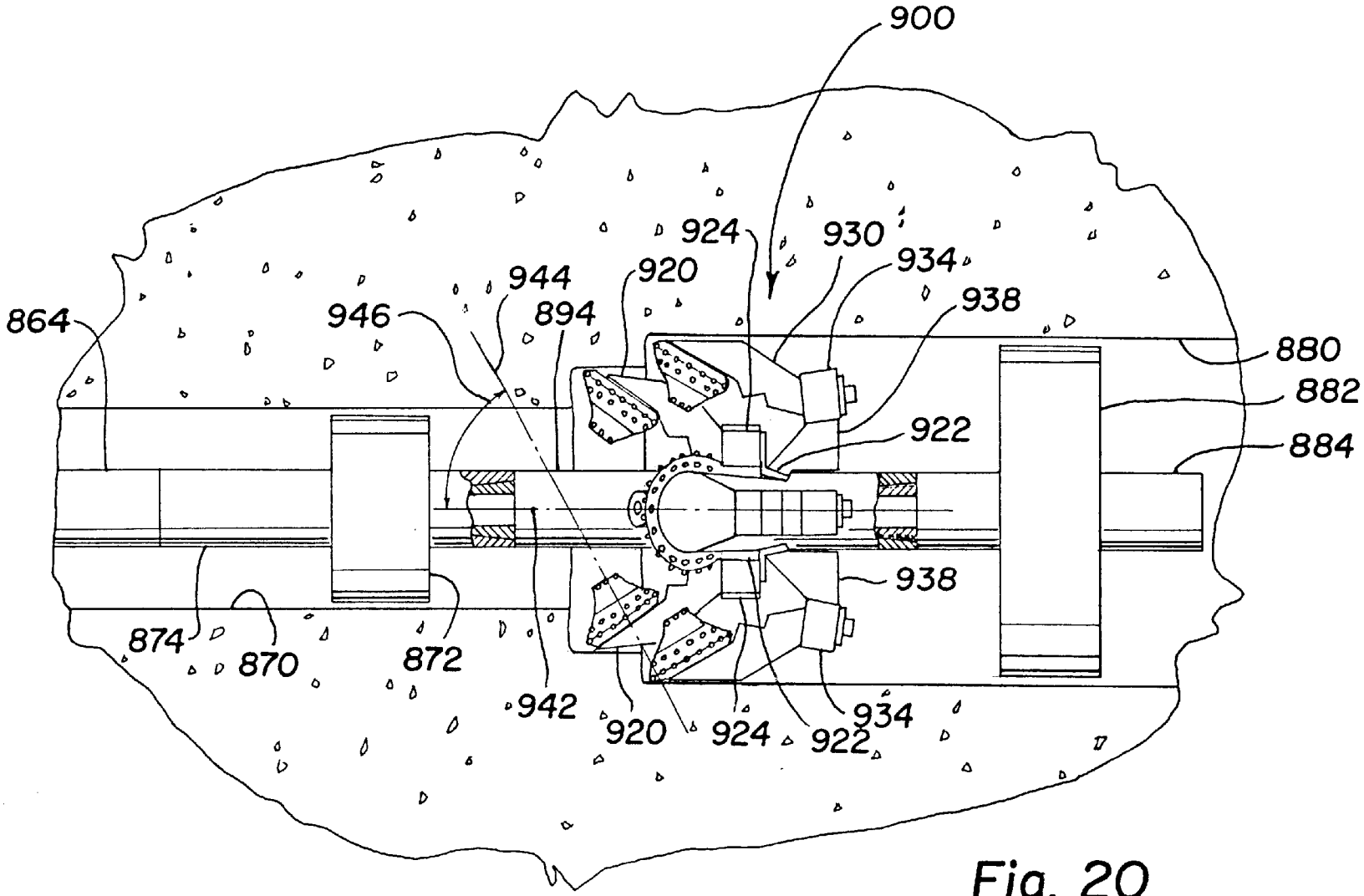
FIG. 20 is a side view of a preferred embodiment of a boring head incorporating he present inventions, as utilized to enlarge a horizontal pilot hole.

FIG. 20 illustrates the application of a boring head 900 of the present inventions, with rotatable cutter bit assemblies 920 and 930 incorporating the inventions of FIG. 17 and further equipped with both leading and trailing cylindrical guides 872 and 882 respectively. Here, boring head 900 is used for enlargement of secondary bore 870 to a tertiary bore 880 of yet larger diameter. Secondary bore 870 may be considered as an example of a pilot bore enlargement accomplished with boring head 850 of FIG. 18 and boring head 900 as a larger size boring head of the same inventions. In this case, secondary bore 870 becomes a pilot bore for boring head 900.

Drill pipe 864 is operatively connected to a drilling rig (not shown) positioned in a pipeline trench beyond the unshown end of secondary bore 870. Leading cylindrical guide 872 is concentrically mounted on drill pipe length 874, where it is connected between drill pipe 864 and axial center member 894 of boring head 900. Cylindrical guide 872 thus, engages secondary bore 870 and guides boring head 900 along the path thereof. Internally tapered pockets 924 are radially spaced from axial member 894 by spacers 922 to position cutter bit assemblies 920 at an intermediate radius and internally tapered pockets 930 are radially spaced from axial member 894 by brackets 938 to position cutter bit assemblies 930 for cutting the radius of tertiary bore 880. Trailing cylindrical guide 882 is concentrically mounted on drill pipe length 884, where it is connected to axial center member 894 of boring head 900. Cylindrical guide 882 thus, engages tertiary bore 880 and stabilizes boring head 900 to better follow the path of secondary bore 870. This added stability is particularly beneficial for lengthy pilot bore enlargements and more especially so as the ratio of the enlarged bore diameter to the pilot bore diameter increases.

It is also shown in boring head 900, that rolling axis 944 of rotatable cutter bit assemblies 920 is disposed at a typical angle 946 in the range of between ten and eighty degrees with respect to central axis 942 of boring head axial member 894.

Although the inventions have been described with reference to these preferred embodiments, other embodiments can achieve the same results. Variations and modifications of the present invention will be apparent to those skilled in the art without departing from the scope and spirit of the present inventions.

Having described the invention, what is claimed is:

1. A boring head for use in mounting to a drill pie of a rotary drilling rig for enlarging a pilot bore in horizontal boring, the boring head comprising;

(a) an axial member positioned along a central axis of the boring head for connecting the boring head to the drill pipe of the drilling rig;

(b) a plurality of pockets mounted about the periphery of said axial member, each said pocket being externally configured for fixed attachment to said boring head and having an internal cavity with a longitudinal axis generally parallel to said central axis, said cavities being tapered along said longitudinal axis;

(c) a plurality of bit bodies fitting tightly within said tapered cavities; and (d) an independently rotatable cutter bit mounted on each said bit body and rotating about a rolling axis, fixed with respect to its said bit body and extending at an acute angle between ten degrees and eighty degrees relative to said central axis.

2. The boring head according to claim 1, wherein said axial member further comprises a concentrically attached cylindrical guide of a diameter chosen to engage said pilot bore.

3. The boring head according to claim 1, wherein said axial member comprises:

a cylindrical tubing having a connector adapted for securing said cylindrical tubing to the drill pipe for retaining the boring head on the drill pipe.

4. The boring head according to claim 1, wherein at least one of said plurality of pockets is mounted at a first radial distance from said central axis, said first radial distance being less than a second radial distance at which at least one other said pocket is mounted, so that a first said rotatable cutting bit, fitted into said at least one pocket, and a second said rotatable cutting bit, fitting into said at least one other pocket, follow offset arcuate paths when said axial member is rotated.

5. The boring head according to claim 4, wherein the first radial distance from the central axis is substantially equal to the radius of the pilot bore, and the second radial distance is greater than the radius of the pilot bore.

6. The boring head according to claim 4, wherein the difference between the first radial distance and the second radial distance is such that said first and second cutter bits cut across different but overlapping widths of arcuate cutting paths relative to the central axis.

7. The boring head according to claim 4, wherein said axial member comprises: a cylindrical tubing having a connector adapted for securing said cylindrical tubing to the drill pipe for retaining the boring head on the drill pipe.

8. A replaceable cutter bit assembly for mounting on a boring head to be driven by a rotary drilling rig drill pipe, comprising:

(a) a pocket having a longitudinal axis, the pocket being internally tapered along said longitudinal axis and externally configured for fixed attachment to said boring head;

(b) a bit body, said bit body being externally tapered and fitting tightly within said pocket;

(c) an independently rotatable cutter bit mounted on said bit body so as to rotate about a rolling axis, fixed with respect to said bit body and extending at an acute angle ranging between ten degrees and eighty degrees relative to said longitudinal axis; and (d) retaining means acting alone said longitudinal axis for holding said bit body in said pocket.

9. The replaceable cutter bit assembly according to claim 8 and further comprising:

an axial member for connection with said drill pipe, with said pocket being fixedly attached to said axial member.

10. The replaceable cutter bit assembly according to claim 8, wherein said retaining means comprises a threaded bolt acting along said longitudinal axis for holding said bit body in said pocket.

11. A method for replaceable mounting of independently rotatable cutter bit assemblies on a boring head, the boring head having a longitudinal axis, the method comprising the steps of:

attaching to the boring head a pocket that is externally configured for fixed attachment to the boring head and having an internally tapered cavity matching a tapered body and oriented to receive the tapered body of an independently rotatable cutter bit, the tapered cavity having a longitudinal axis parallel to the longitudinal axis of the boring head;

drawing the tapered body into the tapered cavity with a threaded retainer acting along the longitudinal axis of the tapered cavity;

forcing the tapered body into the tapered cavity with working loads against the independently rotatable cutter bit.

12. A boring head for use in mounting to a drill pipe of a rotary drilling rig for enlarging a pilot bore in horizontal boring, the boring head comprising;

(a) an axial member positioned along a central axis of the boring head for connecting the boring head to the drill pipe of the drilling rig;

(b) a cylindrical guide of a diameter chosen to engage said pilot bore, concentrically attached to said axial member so as to be positioned to extend into said pilot bore and guide said boring head along the path thereof;

(c) a plurality of pockets mounted on said axial member, each said pocket having an internal cavity with a longitudinal axis generally parallel to said central axis, said cavities being tapered along said longitudinal axis of said pocket;

(d) a plurality of bit bodies fitting tightly within the respective internal cavities of said plurality of pockets; and (e) an independently rotatable cutter bit mounted on each said bit body and rotating about a rolling axis, fixed with respect to its respective said bit body and extending at an acute angle ranging between approximately ten and eighty degrees relative to said central axis;

(f) at least one of said plurality of pockets is mounted at a first radial distance from said central axis, said first radial distance being less than a second radial distance at which at least one other said pocket is mounted, so that a first said rotatable cutting bit, fitted into said at least one pocket, and a second said rotatable cutting bit, fitted into said at least one other pocket, follow offset arcuate paths when said axial member is rotated and so that at least said second rotatable cutting bit is positioned to enlarge said pilot bore to a second bore diameter; and (g) a second cylindrical guide of a diameter chosen to engage said second bore diameter, concentrically attached to said axial member so as to be positioned to extend into said second bore and stabilize said boring head for boring along the path of said pilot bore.

13. The boring head according to claim 12, wherein said axial member comprises: a cylindrical tubing having a connector adapted for securing said cylindrical tubing to the drill pipe for retaining the boring head on the drill pipe.

14. The boring head according to claim 12, wherein the first radial distance from the central axis is substantially equal to the radius of the pilot bore, and the second radial distance is greater than the radius of the pilot bore.

15. The boring head according to claim 12, wherein the difference between the first radial distance and the second radial distance is such that said first and second cutter bits cut across different but overlapping widths of arcuate cutting paths relative to the central axis.

* * * * *

UNITED STATES PATENT AND TRADEMARK OFFICE

CERTIFICATE OF CORRECTION

PATENT NO. : 5,979,574

DATED : November 9, 1999

INVENTOR(S) : Mark Osadchuk

It is certified that error appears in the above-identified patent and that said Letters Patent is hereby corrected as shown below:

Column 1, line 5 before "entitled" insert -- originally --;

Column 1, line 34 change "is" to -- are --;

Column 1, line 36 after "impossible" insert -- , --;

Column 2, line 3 change "are" to -- is --;

Column 2, line 46 change "maintains" to -- maintain --;

Column 2, line 48 change "of" to -- off --;

Column 4, line 62 after "4" insert -- is a --;

Column 6, line 62 change "operative" to --operatively --;

Column 11, line 13 after "mounted" insert -- to --;

Column 12, line 66 change "a" to -- an --;

Column 13, line 1 change "a" to -- an --;

Column 14, line 35 after "can" insert -- be --;

Column 15, line 15 after "can" insert -- be --;

Column 15, line 35 delete "a";

Column 15, line 66 delete "an";

Column 16, line 4 change "612" to -- 712 --;

Column 16, line 13 change "12" to -- 712 --;

Column 16, line 14 change "10" to -- 710 --;

Column 16, line 27 change "112" to -- 812 --;

Column 16, line 28 change "12" to -- 712 --;

Column 17, line 5 change "112" to -- 812 --;

UNITED STATES PATENT AND TRADEMARK OFFICE

CERTIFICATE OF CORRECTION

PATENT NO. : 5,979,574

DATED : November 9, 1999

INVENTOR(S) : Mark Osadchuk

It is certified that error appears in the above-identified patent and that said Letters Patent is hereby corrected as shown below:

Column 17, line 66 delete "the" first occurrence;

Column 18, line 43 change "82b" to -- 820b --;

Column 18, line 55 after "882" insert -- , -- ;

Column 19, line 1 after "thus" delete -- , --;

Column 19, line 11 after "thus" delete -- , --;

Column 19, line 29 change "pie" to -- pipe --;

column 19, line 31 change ";" to -- : --;

Column 19, line 46 after "angel" insert -- ranging --;

Column 20, line 26 change "alone" to -- along --;

column 21, line 6 delete "and".

Signed and Sealed this

Thirtieth Day of January, 2001

*Attest:*

*Attesting Officer*

Q. TODD DICKINSON

*Director of Patents and Trademarks*